US011016423B2

(12) United States Patent
Koyama

(10) Patent No.: US 11,016,423 B2
(45) Date of Patent: May 25, 2021

(54) IMAGE FORMING APPARATUS HAVING VARIABLE FIXING TEMPERATURE AND NIP WIDTH

(71) Applicant: BROTHER KOGYO KABUSHIKI KAISHA, Nagoya (JP)

(72) Inventor: Tatsuya Koyama, Toyoake (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/701,458

(22) Filed: Dec. 3, 2019

(65) Prior Publication Data

US 2020/0192256 A1 Jun. 18, 2020

(30) Foreign Application Priority Data

Dec. 13, 2018 (JP) ..... JP2018-233266

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2039; G03G 15/205
See application file for complete search history.

(56) References Cited

U.S. PATENT DOCUMENTS

| | | | | |
|---|---|---|---|---|
| 7,787,788 | B2 * | 8/2010 | Nakamura | G03G 15/2039 399/69 |
| 8,509,639 | B2 * | 8/2013 | Tao | G03G 15/2039 399/67 |
| 9,025,982 | B2 * | 5/2015 | Kameda | G03G 15/2046 399/67 |
| 9,817,345 | B2 * | 11/2017 | Yamano | G03G 15/2039 |
| 10,191,423 | B2 * | 1/2019 | Sugiyama | G03G 15/2064 |
| 2016/0370741 | A1 * | 12/2016 | Hayashi | G03G 15/2039 |

FOREIGN PATENT DOCUMENTS

| | | | |
|---|---|---|---|
| JP | 2009-75499 | A | 4/2009 |
| JP | 2010-2670 | A | 1/2010 |
| JP | 2010-256505 | A | 11/2010 |
| JP | 2014-63003 | A | 4/2014 |

* cited by examiner

*Primary Examiner* — Walter L Lindsay, Jr.
*Assistant Examiner* — Milton Gonzalez
(74) *Attorney, Agent, or Firm* — Merchant & Gould P.C.

(57) ABSTRACT

An image forming apparatus has a heating roller and a pressing roller, a nip being formed therebetween, and a controller configured to perform a heating controlling process of raising the temperature of the heating roller toward a fixing temperature, a rotational controlling process of rotating the heating roller and the pressing roller when a detected temperature of the heating roller is equal to or higher than a first threshold temperature, and a conveyance controlling process of conveying the sheet toward the developing device when the detected temperature is equal to or higher than a second temperature higher than the first temperature and lower than the fixing temperature. The controller is configured to set the first temperature to be lower in a case where a nip width is the second width than in a case where the nip width is the first width.

18 Claims, 12 Drawing Sheets

IMAGE FORMING APPARATUS HAVING VARIABLE FIXING TEMPERATURE AND NIP WIDTH

CROSS-REFERENCE TO RELATED APPLICATIONS

This application claims priority under 35 U.S.C. § 119 from Japanese Patent Application No. 2018-233266 filed on Dec. 13, 2018. The entire subject matter of the application is incorporated herein by reference.

BACKGROUND

Technical Field

Present disclosures relate to an image forming apparatus provided with a fixing device configured to fix developer onto a sheet.

Related Art

There has been known an image forming apparatus configured to form an image on a sheet according to an electrophotographic imaging method. Typically, such an image forming apparatus has a heating roller and a pressing roller configured to nip a sheet therebetween, and a switching mechanism configured to switch a nip width of the nip formed between the heating roller and the pressing roller. For example, there has been known a switching mechanism configured to move a pressure arm, which supports the pressing roller, so that an urging force to urge the pressing roller toward the heating roller is changed to adjust the nip width.

SUMMARY

Incidentally, when the nip width is relatively smaller, a contact area of the heating roller and the pressing roller is smaller, and heat of the heating roller is less likely conducted to the pressing roller and it takes more time, since heating of the pressing roller is started, to raise the temperature of the pressing roller within a temperature range appropriate for fixing. In such a case, when the sheet is normally conveyed to the fixing device, the sheet may reach the nip between the heating roller and the pressing roller before the temperature of the pressing roller may not have reached the appropriate temperature range for fixing and there may occur a fixing failure.

According to aspects of the present disclosures, there is provides an image forming apparatus, which has a developing device configured to form a developer image on a sheet, a conveyer configured to convey the sheet toward the developing device, a fixing device having a heating roller and a pressing roller which are configured to sandwich the sheet, on which the developer image is formed, therebetween to apply heat and pressure to the sheet to fix the developer image on the sheet, a temperature detector configured to detect a temperature of the heating roller, a switching mechanism configured to switch a nip width of a nip, which is formed between the heating roller and the pressing roller, between a first width and a second width, the second width being smaller than the first width and a controller. The controller is configured to perform a heating controlling process of raising the temperature of the heating roller toward a fixing temperature necessary to fix the developer image on the sheet based on a detected temperature which is the temperature detected by the temperature detector, a rotational controlling process of controlling rotation of the heating roller and the pressing roller the fixing device, the rotational controlling process not being performed when the detected temperature is lower than a first temperature which is lower than the fixing temperature, the rotational controlling process being performed when the detected temperature is equal to or higher than the first temperature, and a conveyance controlling process of controlling the conveyer to convey the sheet toward the developing device when the detected temperature is equal to or higher than a second temperature, which is higher than the first temperature and lower than the fixing temperature. In the rotational controlling process, the controller sets the first temperature to be lower in a case where the nip width is the second width than in a case where the nip width is the first width.

According to aspects of the present disclosures, there is provides an image forming apparatus, which has a developing device configured to form a developer image on a sheet, a conveyer configured to convey the sheet toward the developing device a fixing device having a heating roller and a pressing roller which are configured to sandwich the sheet, on which the developer image is formed, therebetween to apply heat and pressure to the sheet to fix the developer image on the sheet a temperature detector configured to detect a temperature of the heating roller, a switching mechanism configured to switch a width of a nip, which is formed between the heating roller and the pressing roller, between a first width and a second width, the second width being smaller than the first width and a controller. The controller is configured to perform a heating controlling process of raising the temperature of the heating roller toward a fixing temperature necessary to fix the developer image on the sheet based on a detected temperature which is the temperature detected by the temperature detector, a rotational controlling process of controlling rotation of the heating roller and the pressing roller of the fixing device, the rotational controlling process not being performed when the detected temperature is a less than a first temperature which is lower than the fixing temperature, the rotational controlling process being performed when the detected temperature is equal to or higher than the first temperature, and a conveyance controlling process of controlling the conveyer to convey the sheet toward the developing device when the detected temperature is equal to or higher than a second temperature which is higher than the first temperature and lower than the fixing temperature. In the conveyance controlling process, the controller sets the second temperature to be higher in a case where the nip width is the second width than in a case where the nip width is the first width.

According to aspects of the present disclosures, there is provides an image forming apparatus, which has a developing device configured to form a developer image on a sheet, a conveyer configured to convey the sheet toward the developing device, a fixing device having a heating roller and a pressing roller which are configured to sandwich the sheet, on which the developer image is formed, therebetween to apply heat and pressure to the sheet to fix the developer image on the sheet, a temperature detector configured to detect a temperature of the heating roller, a switching mechanism configured to switch a width of a nip between the heating roller and the pressing roller between a first width and a second width, the second width being smaller than the first width and a controller. The controller is configured to perform a heating controlling process of raising the temperature of the heating roller toward a fixing temperature necessary to fix the developer image on the sheet based on a detected temperature which is the temperature detected by the temperature detector, a rotational controlling process of controlling rotation of the heating roller and the pressing roller of the fixing device, the rotational controlling process not being performed when the detected temperature is a less than a first temperature which is lower than the fixing temperature, the rotational controlling process being performed when the detected temperature is equal to or higher than the first temperature, and a conveyance controlling process of controlling the conveyer to convey the sheet toward the developing device after a particular time period has elapsed since the detected temperature becomes a second temperature which is higher than the first temperature and lower than the fixing temperature. In the conveyance controlling process, the controller sets the particular time period to be longer in a case where the nip width is the second width than in a case where the nip width is the first width.

BRIEF DESCRIPTION OF THE ACCOMPANYING DRAWINGS

DETAILED DESCRIPTION OF THE EMBODIMENTS

Hereinafter, referring to the accompanying drawings, embodiments and modifications according to the present disclosures will be described.

Figure 1:
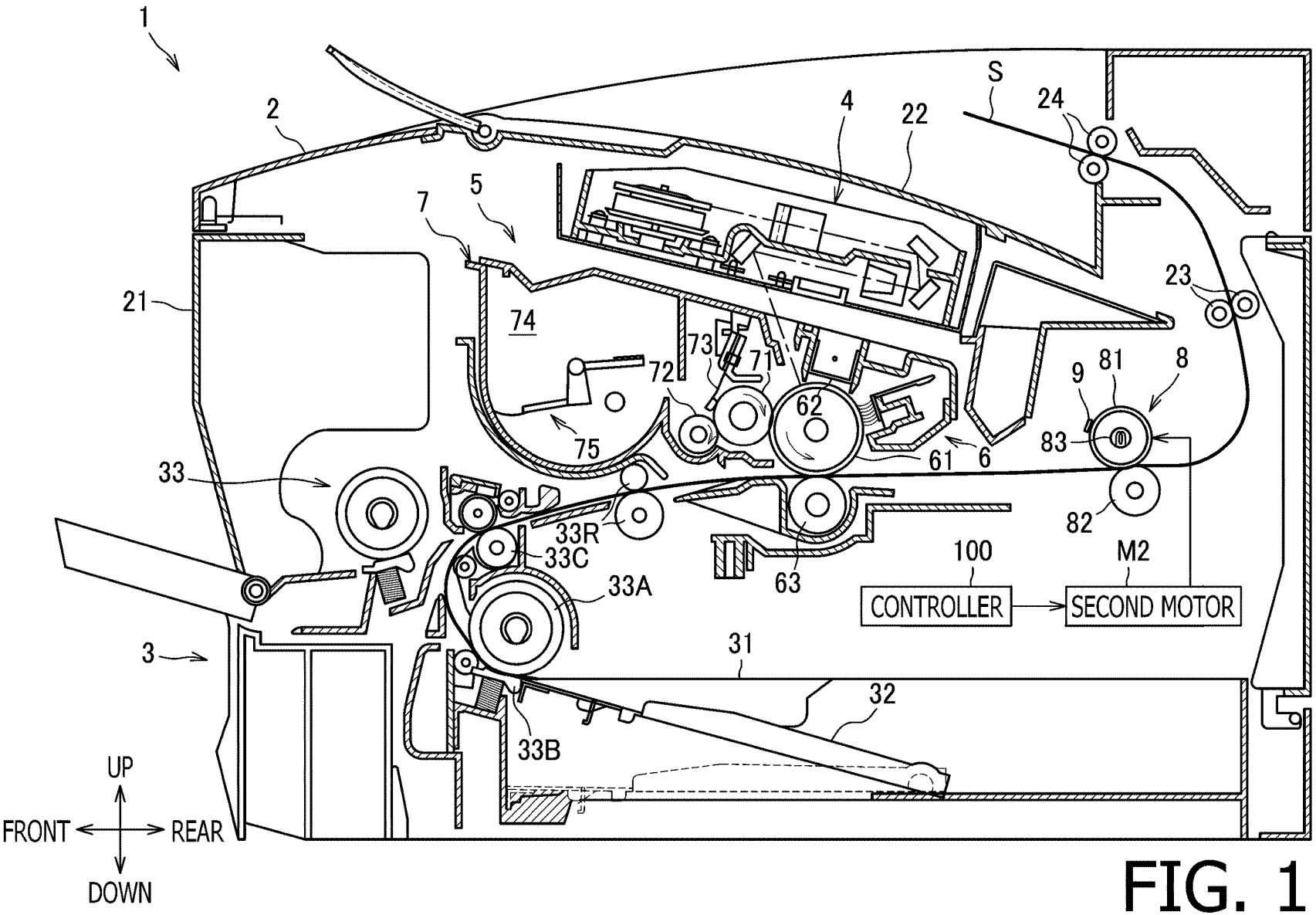
FIG. 1 shows a cross-sectional side view of an image forming apparatus schematically showing a configuration of the image forming apparatus.

As shown in FIG. 1, a laser printer (which is an example of an image forming apparatus) 1 has a casing 2, a sheet supplying part 3, an exposure device 4, a developing device 5, a fixing device 8, a temperature detector 9, a switching mechanism 10 (see FIG. 3), a position detector 16 (see FIG. 3), a first motor M1 (see FIG. 3), a second motor M2 and a controller 100.

The sheet supplying part 3 is arranged at a lower portion inside the casing 2 and is provided with a sheet tray 31 accommodating sheets S made of, for example, paper. The sheet supplying part 3 is further provided with a pressure plate 32 and a conveying part 33 configured to covey the sheet S toward the developing device 5. The conveying part 33 is provided with a pickup roller 33A, a separation pad 33B, a first conveying roller 33C, a registration roller 33R and the like. The sheet supplying part 3 is configured such that the sheets S accommodated in the sheet tray 31 are urged, by the pressure plate 32, toward the pickup roller 33A. The sheet supplying part 3 feeds the sheets S accommodated in the sheet tray 31 one by one with separating each sheet S using the pickup roller 33A and the separation pad 33B, conveys each separated sheet S to the developing device 5 using the first conveying roller 33C and the registration roller 33R.

The exposure part 4 is arranged at an upper portion inside casing 2. It is noted that, since the exposure part 4 is of a well-known configuration in this field, a light source of the exposure part 4 is not shown in FIG. 1, while a polygonal mirror, lenses and reflectors which are shown in FIG. 1 without reference numerals assigned thereto. The exposure part 4 is configured such that a light beam (indicated by dotted lines) emitted by the light source and modulated based on image data is scanned on a surface of the photosensitive drum 61, thereby the surface of the photosensitive drum 61 being exposed to the light beam carrying the image data.

The developing device 5 is a device configured to form a developer image on the sheet S and is arranged below the exposure part 4. The developing device 5 is detachably attached to the casing, as a process cartridge, through an opening which is formed when the front cover 21 provided on a front part of the casing is opened. The developing device 5 includes a photosensitive cartridge 6 and a developing cartridge 7.

The photosensitive cartridge 6 is provided with a photosensitive drum 61 which is a circular cylinder-shaped photosensitive drum, a charging device 62 which is a corona charger, and a transfer roller 63. The developing cartridge 7 is configured to be detachably attached to the photosensitive cartridge 6 and is provided with a developing roller 71, a supplying roller 72, a regulating blade 73, a container 74 configured to contain developer composed of dry toner and an agitator 75.

The developing device 5 is configured such that a circumferential surface of the photosensitive drum 61 is uniformly charged by the charging device 62. Thereafter, as the circumferential surface of the photosensitive drum 61 is exposed to the light beam emitted by the exposure part 4, an electrostatic latent image is formed, according to the image data, on the circumferential surface of the photosensitive drum 61. Incidentally, the developer in the container 74 as agitated by the agitator 75 and supplied to the supplying roller 72. Then, the supplied developer is supplied from the supplying roller 72 to the developing roller 71. As the developing roller 71 rotates, the developer enters between the developing roller 71 and the regulating blade 73, and is held on the developing roller 71 as a thin layer having a substantially constant thickness.

The developing device 5 supplies the developer held on the developing roller 71 from the developing roller 71 onto the electrostatic latent image formed on the photosensitive drum 61. Accordingly, the electrostatic latent image is developed, thereby a developer image being formed. Thereafter, as the sheet S passes between the photosensitive drum 61 and the transfer roller 63, the developer image on the photosensitive drum 61 is transferred onto the sheet S.

The fixing device 8 is a device configured to fix the developer image onto the sheet S, and is arranged on a rear side with respect to the developing device 5. The fixing device 8 has a heating roller 81, a pressing roller 82 and a heater 83.

The heating roller 81 is a cylindrical heating roller made of metal. The heating roller 81 is configured to contact the sheet S conveyed between the heating roller 81 and the pressing roller 82 to apply heat to the sheet S.

The pressing roller 82 is composed such that a core metal 82A (see FIG. 2) is surrounded by an elastic layer 82B. The pressing roller 82 is arranged at a position where the pressing roller 82 contacts the heating roller 81 and the sheet S is sandwiched between the pressing roller 82 and the heating roller 81.

The heater 83 is a heat source configured to heat the heating roller 81 and the pressing roller 82. According to the present embodiment, the heater 83 is configured as a halogen heater having a filament 83A (see FIG. 2) and is configured to heat the heating roller 81 with radiation heat. Further, the heat of the heating roller 81 is conducted to the pressing roller 82 to heat the same. The heater 83 is arranged inside the heating roller 81. The heating roller 81 is configured to be heated by the heater 83. The pressing roller 82 is configured to be heated by the heating roller 81.

The heating roller 81 and the pressing roller 82 of the fixing device 8 are driven to rotate as a second motor M2 provided inside the casing 2 is driven to rotate. For example, as a driving force is input to the fixing device 8 from the second motor M2, the heating roller 81 is driven to rotate, and in association with rotation of the heating roller 81, the pressing roller 82 is driven to rotate. Hereinafter, a process of controlling the heating roller 81 and pressing roller 82 to rotate will be referred to as a rotational controlling process.

The fixing device 8 is configured such that, as the sheet S is conveyed between the heating roller 81 and the pressing roller 82, the fixing device 8 applies heat and pressure to sheet S bearing the developer image transferred onto the sheet S. The sheet S on which the developer image is fixed is then discharged, by a second conveying roller 23 and a discharging roller 24, onto a discharged sheet tray 22.

Figure 2:
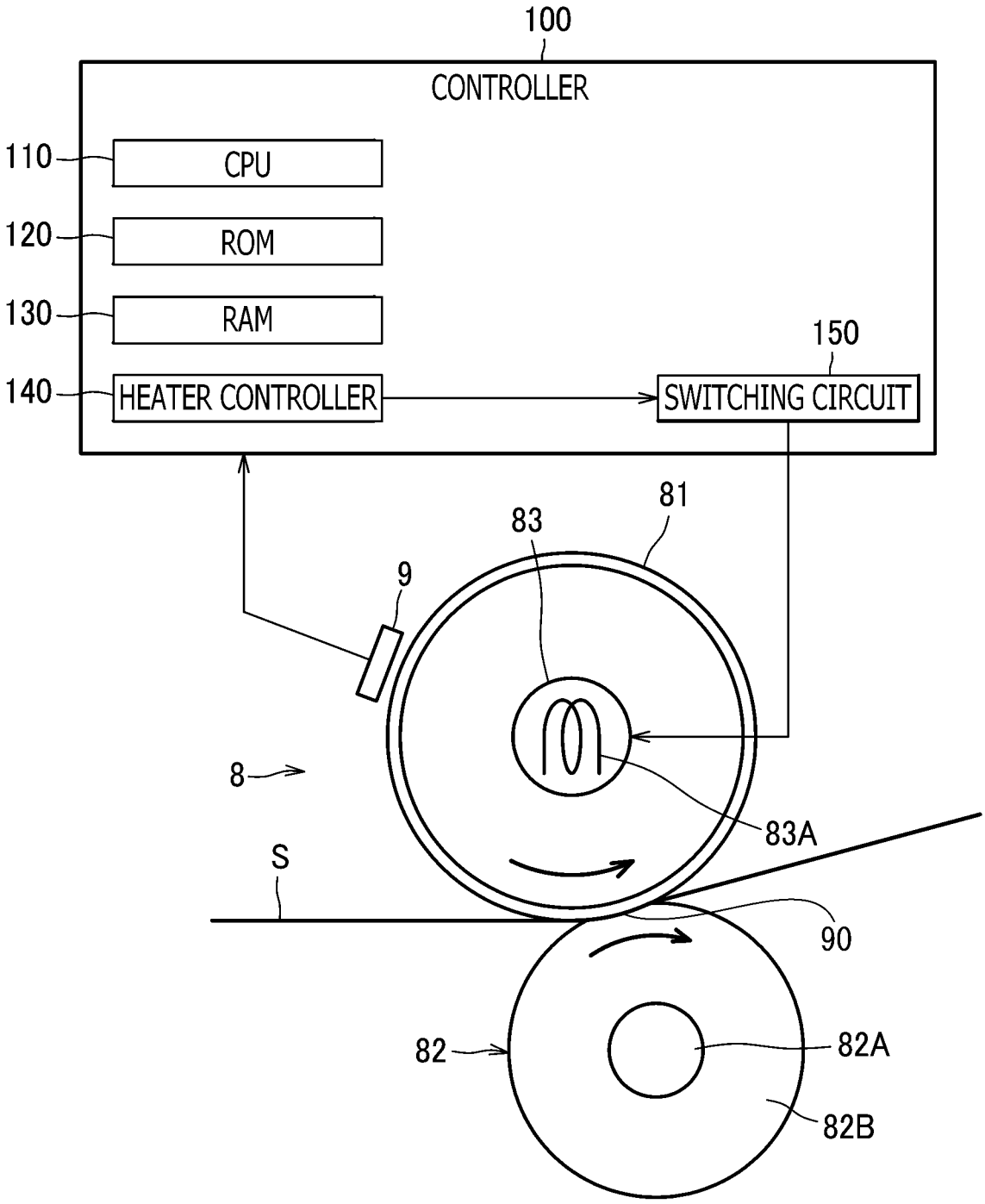
FIG. 2 shows a configuration to control a heater.

The controller 100 is a device configured to control respective components (e.g., the fixing device 8, the motors M1 and M2, and the like) of the laser printer 1. The controller 100 is composed of a single, or a plurality of electrical circuits. The controller 100 performs controlling of respective components by outputting control signals and/or driving voltages to respective components of the laser printer 1. As shown in FIG. 2, the controller 100 has a CPU 110, a ROM 120, a RAM 130, a heater controller 140, a switching circuit 150 and the like.

The CPU 110 is configured to command operation timings of respective components of the laser printer 1, and transmit a command value indicating a target temperature of the fixing device 8. The ROM 120 is used to store various programs for controlling respective components of the laser printer 1. The ROM 120 is also configured to store various pieces of data such as setting information and the like for respective components of the laser printer 1. The RAM 130 is used as a work area when the CPU 110 executes various programs and for providing storage areas for temporarily store various pieces of data.

The heater controller 140 is configured to set a duty ratio of the switching circuit 150 based on the target temperature of the fixing device 8 and a detected temperature T which is detected by the temperature detector 9. According to the present embodiment, the CPU 110 and the heater controller 140 are integrated into a single semiconductor element. The switching circuit 150 energizes the heater 83 by switching the alternate voltage at the set duty ratio. It is noted that the duty ratio of the switching circuit 150 is a ratio of a time period during which the heater 83 is energized to a sum of time periods during which the heater 83 is energized and is not energized per each switching period.

The temperature detector 9 is a sensor configured to detect the temperature of the heating part 81. According to the present embodiment, the temperature detector 9 is arranged to face a surface of the heating roller 81 with a particular clearance therebetween. The temperature detector 9 outputs a signal corresponding to the temperature of the heating roller 81 to the controller 100. The controller 100 obtains the detected temperature T as the temperature of the heating roller 81 based on the signal output by the temperature detector 9.

It is noted that the detected temperature T, which the controller 100 obtains based on the output signal of the temperature detector 9, may not be one corresponding to the output signal of the temperature detector 9 but a temperature compensated to correspond to a surface temperature of the heating roller 81. For example, the detected temperature T may be a temperature, which was obtained based on the output of the temperature detector 9 and then compensated based on an elapsed time since heating of the heating roller 81 was started.

As one example, the controller 100 may obtain the detected temperature T (the compensated T) based on a formula (1) below.

$$T=a(t)\times TS+b(t) \quad (1)$$

It is noted that "TS" is a value representing temperature detected by the temperature detector 9, concretely, the value represented by the output signal of the temperature detector 9. Further, "a(t)" is a compensation coefficient and "b(t)" is a term of compensation. It is noted that each of the compensation coefficient "a(t)" and the compensation term "b(t)" is a function of time "t" which is the elapsed time since the heating of the heating roller 81 was started.

Figure 3:
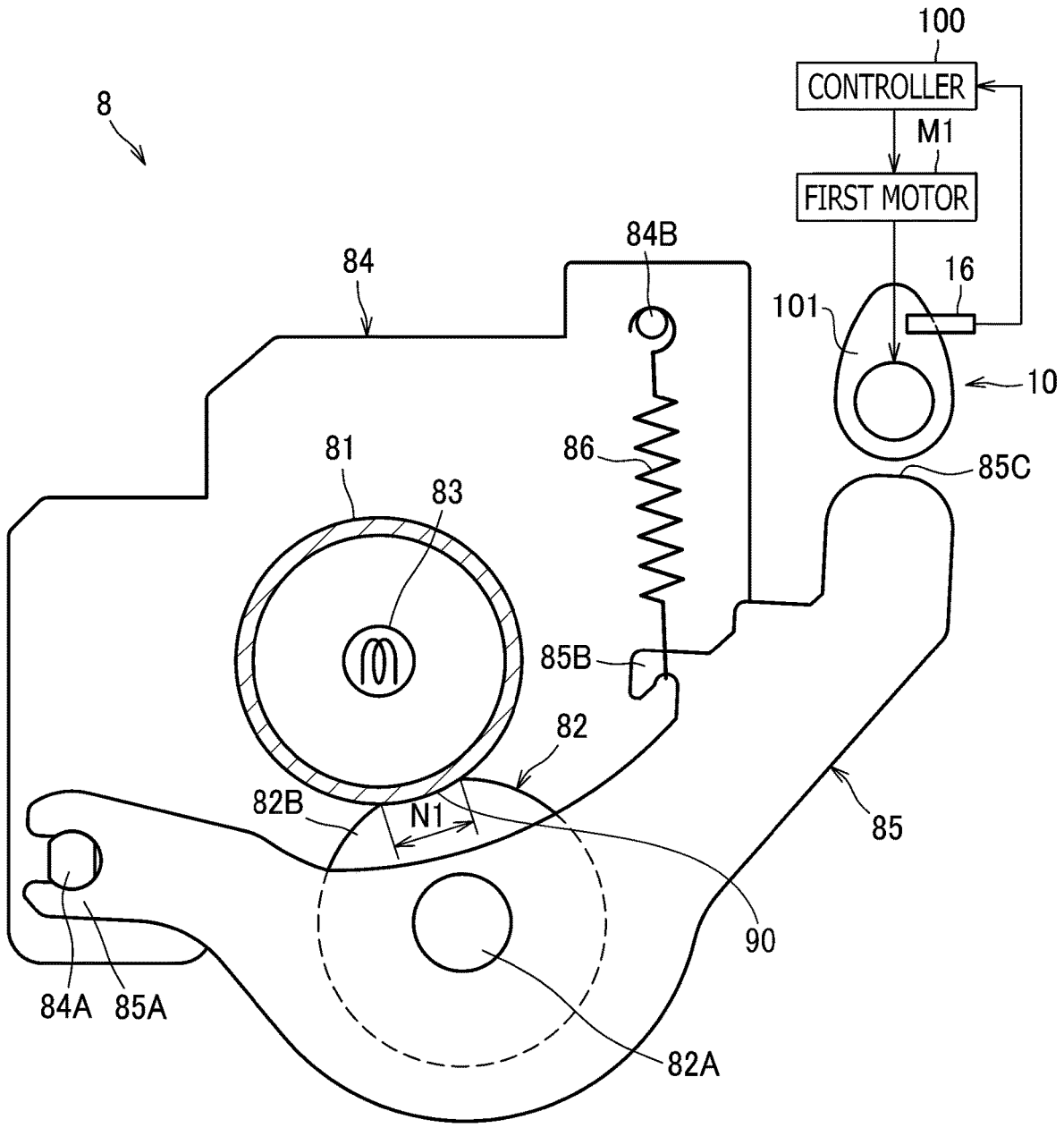
FIG. 3 shows a fixing device provided with a switching mechanism and having a first width.

As shown in FIG. 3, the fixing device 8 has a first frame 84, a second frame 85 and a spring 86 which are configured to urge the pressing roller 82 toward the heating roller 81. Portions of the first frame 84 with which the second frame 85 and the spring 86 engage, the second frame 85 and the spring 86 are provided at each of both end portions in a direction of a rotation axis of the fixing device 8 (i.e., in FIG. 3, the second frame 85 and the spring 86 at one end portion in the axial direction are shown).

The first frame 84 is a member which rotatably supports the heating roller 81 and has a shaft 84A and a first spring engagement portion 84B.

The second frame 85 is a member which rotatably supports the pressing roller 82 and has a shaft engaging portion 85A, a second spring engagement portion 85B and a cum contact surface 85C. The second frame 85 is configured such that the shaft engaging portion 85A engages with the shaft 84A of the first frame 84 and the second frame 85 is supported rotatably, with respect to the first frame 84, about the shaft 84A.

Figure 4:
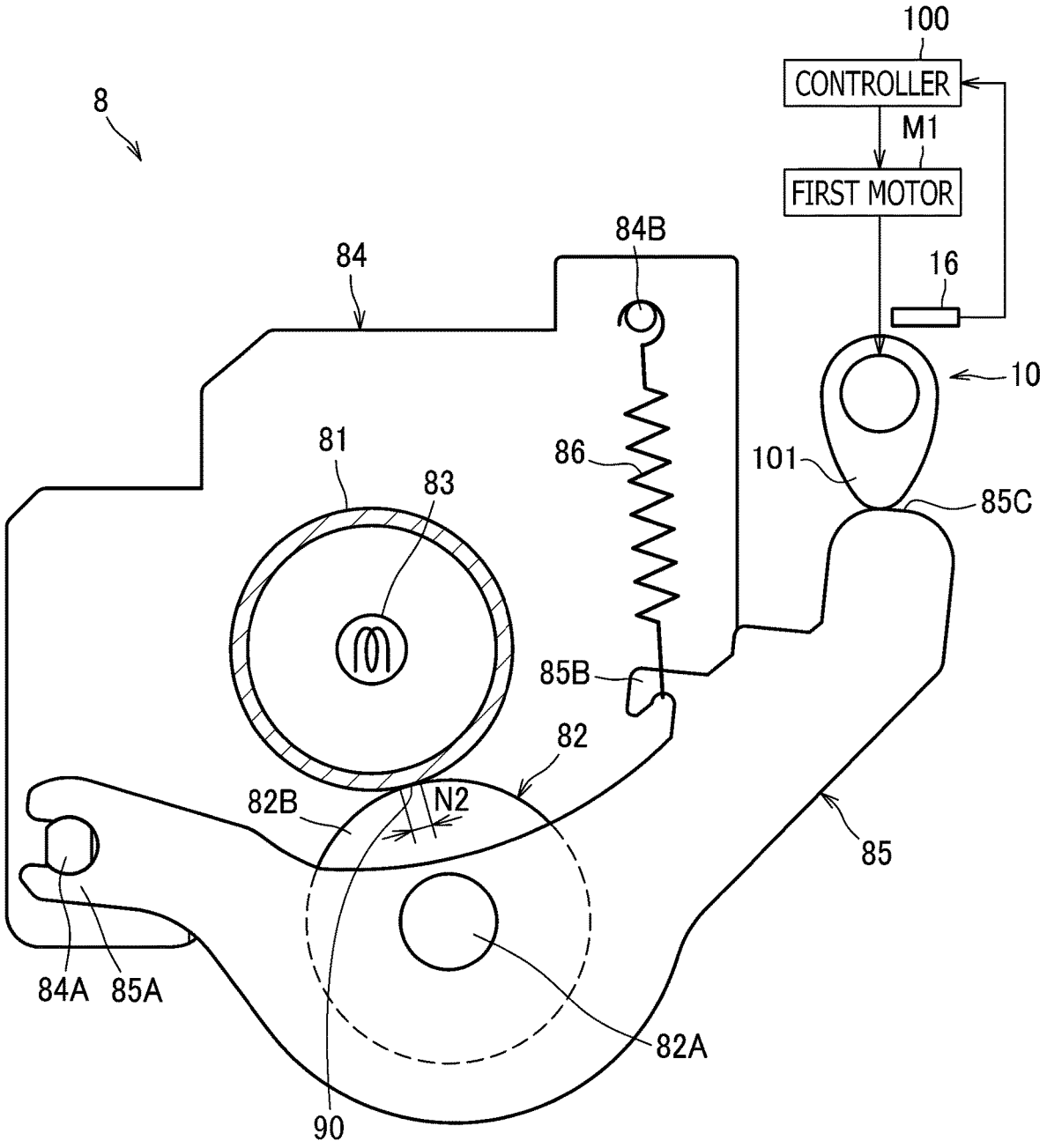
FIG. 4 shows a fixing device provided with the switching mechanism and having a second width.

Between the heating roller 81 and the pressing roller 82, a nip portion 90, at which the sheet S is sandwiched by the heating roller 81 and the pressing roller 82, is formed. The second frame 85 is rotatably movable between a first nip position (as shown in FIG. 3) at which the nip width is a first nip width and a second nip position (as shown in FIG. 4) at which the nip width is a second nip width. The nip width is a length of the nip in a direction where the sheet S is conveyed in the fixing device 8. The second nip width, which is indicated by "N2" in FIG. 4 is smaller than the first nip which is indicated by "N1" in FIG. 3.

The second spring engagement portion 85B and the cam contact portion 85C are arranged on a side opposite to the shaft engaging part 85A, with respect to the nip portion 90, in the conveying direction of the sheet S in the fixing device 8. The second spring engagement portion 85B is provided between shaft engaging portion 85A and the cam contact portion 85C in the conveying direction of the sheet S in the fixing device 8.

The spring 86 is a tension coil spring, one end of which engages with the first spring engagement portion 84B of the frame 84, while the other end of which engages with the second spring engagement portion 85B of the second frame 85.

In the present embodiment, the spring 86 urges, through the second frame 85, the pressing roller 82 toward the heating roller 81 when the second frame 85 is located at the first nip position as shown in FIG. 3 (i.e., when the nip width is the first width N1). On the other hand, the urging force of the spring 86 to urge the pressing roller 82 toward the heating roller 81 is regulated by the second frame 85 when the second frame 85 is located at the second nip position as shown in FIG. 4 (i.e., when the nip width is a second width N2). In other words, when the nip width is the second width N2, the nip portion 90 is formed only by elasticity of the elastic layer 82B of the pressing roller 82. It is noted that, according to the present embodiment, the pressing roller 82 is configured to be movable and is urged toward the heating roller 81. The configuration may be modified such that the heating roller 81 is movable and is urged toward the pressing roller 82.

The switching mechanism 10 is a mechanism configured to switch the nip width of the nip, which formed between the heating roller 81 and the pressing roller 82, between the first width N1 and the second width N2. The switching mechanism 10 includes a cam 101 rotatably provided to the casing 2. The switching mechanism 10 is configured to rotate between a spaced position (see FIG. 3) at which the switching mechanism 10 locates the second frame 85 at the first nip position and a contact position (see FIG. 4) at which the switching mechanism 10 locates the second frame 85 at the second nip position.

The cam 101 is spaced from the cam contact portion 85C of the second frame 85 when the cam 101 is located at the spaced position. In this case, the second frame 85 is located at the first nip position as pulled up by the spring 86, and the pressing roller 82 is urged, by the spring 86, toward the heating roller 81. On the other hand, the cam 101 contacts the cam contact portion 85C when the cam 101 is located at the contact position (see FIG. 4). In this case, the second frame 85 is pushed downward by the switching mechanism 10 and located at the second nip position.

The position detector 16 is a sensor configured to detect whether the switching mechanism 10 is located at the spaced position or the contact position. Concretely, the position detector 16 detects the cam 101 when the switching mechanism 10 is located at the spaced position. Specifically, the position detector 16 outputs, for example, an ON signal to the controller 100 when the cam 101 is located at the spaced position as shown in FIG. 3 and output an OFF signal to the controller 100 (or does not output ON signal to the controller 100) when the cam 101 is located at the contact position as shown in FIG. 4.

The first motor M1 is a driving source which drives the switching mechanism 10 to switch the nip width between the first width N1 and the second width N2. Specifically, the first motor M1 rotates the cam 101 from the spaced position to the contact position, thereby switching the nip width from the first width N1 to the second width N2, and rotates the cam 101 from the contact position to the spaced position, there by switching the nip width from the second width N2 to the first width N1.

Driving of the first motor M1 is controlled by the controller 100. The controller 100 controls the first motor M1 to rotate to switch the nip width, and obtains nip width information indicating whether the nip width is the first width N1 or the second width N2 based on a detection result of the position detector 16.

The controller 100 is configured to perform a heat controlling process, a rotational controlling process and a conveyance controlling process. The heat controlling process is a control of heating the heating roller 81 so that the temperature of the heating roller 81 is raised to a fixing temperature Tf based on the detected temperature T detected by the temperature detector 9. Concretely, the controller 100 energizes the heater 83, based on the detected temperature T, so that the temperature of the heating roller 81 is the fixing temperature Tf.

The fixing temperature Tf is a target temperature of the temperature control of the heating roller 81 in order to fix the developer image onto the sheet S. When the temperature of the heating roller 81 is within a particular temperature range including the fixing temperature Tf, fixing of the developer image on the sheet S can be performed by the fixing device 8. For example, the fixing temperature Tf is 200° C. It should be noted that concrete numbers indicated in the present disclosures are only examples.

The controller 100 obtains, in the heat controlling process, a difference between the fixing temperature Tf and the detected temperature T. Concretely, the controller 100 subtracts the detected temperature T from the fixing temperature Tf to determine a difference ΔT. Then, the controller 100 energizes the heater 83 in accordance with the duty ratio corresponding to the difference ΔT to control the temperature of the heating roller 81. It is noted that, in the heat controlling process, the controller 100 makes the duty ratio larger as the difference ΔT is larger.

The duty ratio corresponding to the difference ΔT may be set based on a table which has been prepare in advance to indicate a relationship between the differences ΔT and the duty ratios, respectively. Alternatively, the duty ratio (i.e., an operating amount of the heater 83) may be set with use of a P1 control method or PID control method based on a deviation between the fixing temperature Tf and the detected temperature T.

The rotational controlling process is a process of controlling the fixing device 8 not to rotate the heating roller 81 and the pressing roller 82 when the detected temperature T is less than a first threshold temperature Tth1 after the heat controlling process is started, while controlling the fixing device 8 to rotate the heating roller 81 and the pressing roller 82 when the detected temperature T is equal to or larger than the first threshold temperature Tth1 after the heat controlling process is started. Concretely, after the heat controlling process is started, the controller 100 keeps heating the heating roller 81 and the pressing roller 82 without rotating the same until the detected temperature T reaches the first threshold temperature Tth1, while the controller 100 drives the second motor M2 to rotate so that the heating roller 81 and the pressing roller 82 are heated with being rotated after the detected temperature T has reached the first threshold temperature Tth1. The first threshold temperature Tth1 is a temperature lower than the fixing temperature Tf and is set in advance. For example, the first threshold temperature Tth1 is 125° C.

The conveyance controlling process is a controlling process of conveying the sheet S toward the developing device 5 when the detected temperature T is equal to or lower than a second threshold temperature Tth2 after the heat controlling process is started. Concretely, when the detected temperature T is equal to or higher than the second threshold temperature Tth2 after the heat controlling process is started, the controller 100 causes the pickup roller 33A to rotate by controlling a not-shown clutch mechanism so that a driving force of the second motor M2 is transmitted to the pickup roller 33A, thereby the pickup roller 33A being rotated to feed the sheet S toward the developing device 5. The controller 100 further controls the registration roller 33R to further conveys the sheet S toward the developing device 5. It is noted that the second threshold temperature Tth2 is set in advance and is a temperature higher than the first threshold temperature Tth1 and lower than the fixing temperature Tf. For example, the second threshold temperature Tth2 is 170° C.

The controller 100 starts the heat controlling process when a print instruction and a print job, which contains image data to be printed, are input to the later printer 1, and terminates the heat controlling process when printing is finished. According to the present embodiment, the controller 100 controls the first motor M1 based on nip width setting information, which is input together with the print instruction, to switch the nip width and performs the heat controlling process.

According to the present embodiment, the nip width setting information is information representing a type of the sheet S. For example, when a normal sheet is designated as the type of the sheet S to be used, the controller 100 determines that the nip width is the first width N1 which is larger than the second width N2. That is, when the controller 100 determines, based on the detection result by the position detector 16, that the current nip width is the second width N2, the controller 100 controls the first motor M1 to drive the switching mechanism 10 (i.e., the cam 101) to change the nip width from the second width N2 to the first width N1. It is noted that when the current nip width is the first width N1, the controller 100 maintains the current nip width as it is.

When a thick sheet or an envelope, which is thicker than the normal sheet, is designated as the type of the sheet S, the controller 100 determines the nip width is the second width N2 which is smaller than the first width N1. That is, when the controller 100 determines, based on the detection result by the position detector 16, that the current nip width is the first width N1, the controller 100 controls the first motor M1 to drive the switching mechanism 10 to change the nip width from the first width N1 to the second width N2. It is noted that when the current nip width is the second width N2, the controller 100 maintains the current nip width as it is.

Further, in the rotational controlling process, when the nip width is the second width N2, the controller 100 makes the first threshold temperature Tth1 be lower than the same when the nip width is the first width N1. For example, when the nip width is the first width N1, the controller 100 sets the first threshold temperature Tth1 to a particular temperature. On the other hand, when the nip width is the second width N2, the controller 100 sets the first threshold temperature Tth1 to a temperature lower than the particular temperature by subtracting a first compensation value T11 from the particular temperature.

Further, in the rotational controlling process, when the nip width is the second width N2 and a parameter (hereinafter, referred to as a "usage parameter") LP which increases in accordance with usage of the pressing roller 82 is equal to or larger than a threshold value LPth, the controller 100 sets the first threshold temperature Tth1 to a temperature when the usage parameter LP is smaller than the threshold value LPth.

For example, when the nip width is the second width N2 and the usage parameter LP is equal to or larger than the threshold value LPth, the controller 100 sets the first threshold temperature Tth1 to a temperature which is calculated by subtraction a second compensation value T12 from the particular temperature. The second compensation value T12 is larger than the first compensation value T11. Accordingly, the first threshold temperature Tth1 which is calculated by subtracting the second compensation value T12 from the particular temperature is lower than the first threshold temperature Tth1 which is calculated by subtracting the first compensation value T11 from the particular temperature.

The usage parameter LP is, for example, the total number of sheets S on which fixing (printing) has been performed, the total heating time of the pressing roller 82 (or the heating roller 81), the total rotation time, the total number of rotations and the like. The threshold value LPth is set in advance. The controller 100 resets the usage parameter LP when the fixing device 8 is replaced with a new one.

It is noted that the controller 100 may be configured to determine that the usage parameter LP has reached the threshold value LPth or more when a value obtained by subtracting the usage parameter LP from the threshold value LPth is equal to or less than zero. Optionally or alternatively, the controller 100 may be configured to determine that the usage parameter LP has reached the threshold value LPth or more when at least two of the total number of sheets S on which fixing has been performed, the total heating time, the total rotation time and the total number of rotations and the like reach the respective threshold values or more.

In the present embodiment, in response to a detected temperature T0 when the heat controlling process is started being a particular threshold temperature Tth0 or less, the controller 100 performs changing of the first threshold temperature Tth1 from the particular temperature. That is, when the detected temperature T0 when the heat controlling process is started is higher than the threshold temperature Tth0, the controller 100 does not change the first threshold temperature Tth1 from the particular temperature. The threshold temperature Tth0 is lower than the first threshold temperature Tth1 and is determined in advance. For example, the threshold temperature Tth0 is 50° C.

Figure 5:
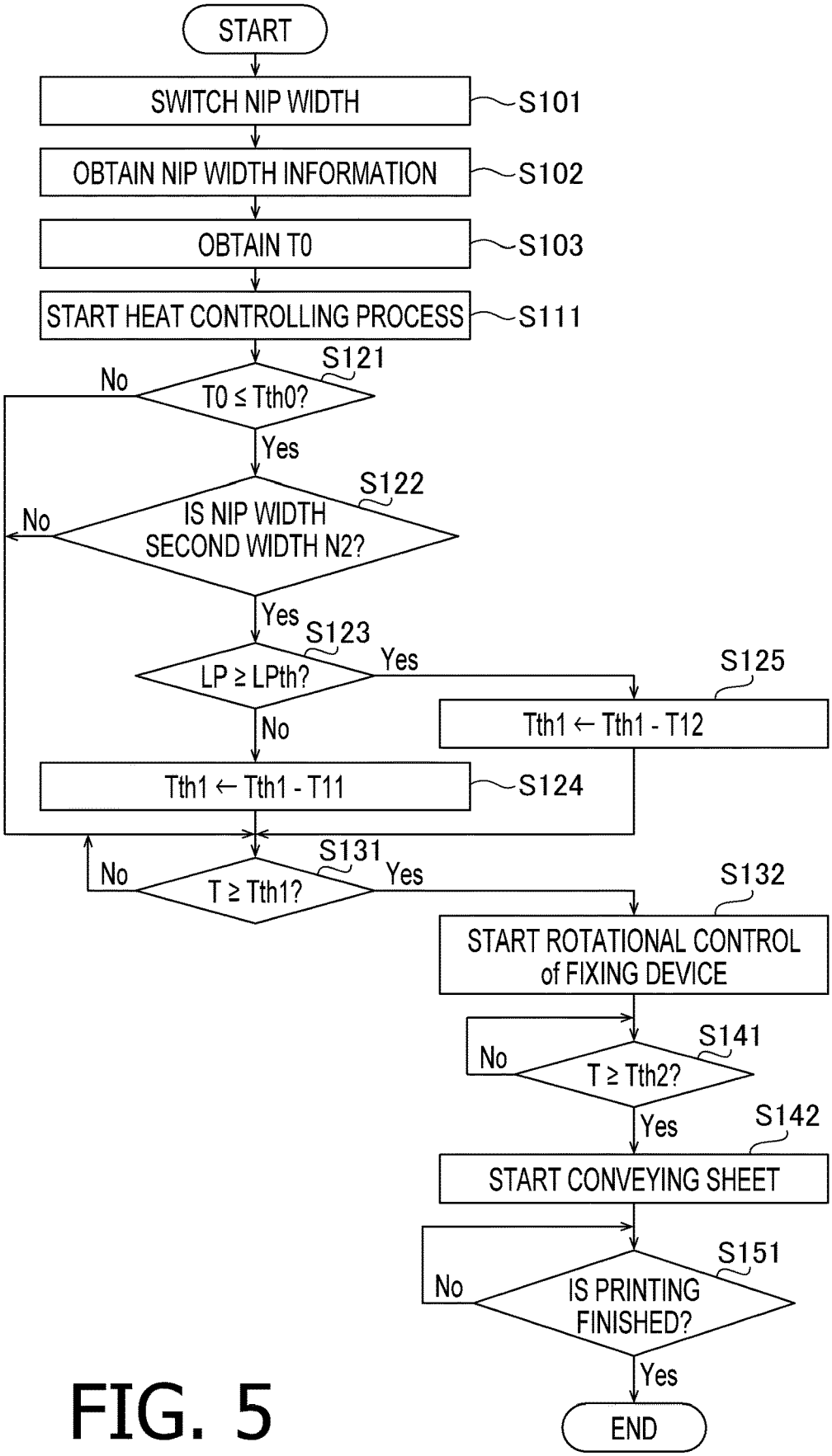
FIG. 5 is a flowchart illustrating an operation of a controller according to a first embodiment.

Next, an operation of the controller 100 will be described, referring to a flowchart shown in FIG. 5. As shown in FIG. 5, when the print job is input, the process shown in FIG. 5 starts. Initially, the controller 100 switches the nip width to the first width N1 or the second width N2 (S101). Then, the controller 100 obtains the nip width information (i.e., whether the current nip width is the first width N1 or the second width N2) based on the detection result by the position detector 16 (S102). Further, the controller 100 obtains a detected temperature T0 when the printing is started (S103).

Thereafter, the controller 100 starts the heat controlling process (S111). Then, the controller 100 determines whether the detected temperature T0 when the printing was started is equal to or lower than the threshold temperature Tth0 (S121). When it is determined that the detected temperature T0 when the printing was started is equal to or lower than the threshold temperature Tth0 (S121: YES), the controller 100 determines whether the nip width is the second width N2 (S122).

When the nip width is not the second width N2 (i.e., when the nip width is the first width N1) (S122: NO), or when the detected temperature T0 at a time when the printing was started is higher than the threshold temperature Tth0 (S121: NO), the controller 100 remains the first threshold temperature Tth1 as the particular temperature and proceeds to S131.

When it is determined that the nip width is the second width N2 (S122: YES), the controller 100 determines whether or not the usage parameter LP is equal to or larger than the threshold value LPth (S123). When it is determined that the usage parameter LP is not equal to or larger than the threshold value LPth (S123: NO), the controller 100 sets the first threshold temperature Tth1 to a temperature which is calculated by subtracting the first compensation value T11 from the first threshold temperature Tth1 (S124), and the controller 100 proceeds to S131.

When the usage parameter LP is equal to or larger than the threshold value LPth (S123: YES), the controller 100 sets the first threshold temperature Tth1 to a temperature which is calculated by subtracting the second compensation value T12 from the first threshold temperature Tth1 (S125), and the controller 100 proceeds to S131.

In S131, the controller 100 determines whether or not the detected temperature T is equal to or higher than the first threshold temperature Tth1. When the detected temperature T is equal to or higher than the first threshold temperature Tth1 (S131: YES), the controller 100 drives the second motor M2 to perform the rotational controlling process of the fixing device 8 (i.e., to rotate the heating roller 81 and the pressing roller 82) (S132).

Next, the controller 100 determines whether or not the detected temperature T is equal to or higher than the second threshold temperature Tth2 (S141). When it is determined that the detected temperature T is equal to or higher than the second threshold temperature Tth2 (S141: YES), the controller 100 drives the pressure plate 32 and the conveyer 33 to start conveying the sheet S toward the developing device 5 (S142).

Thereafter, the controller 100 performs image formation (i.e., printing) on the sheet S. When printing is completed (S151: YES), the controller 100 terminates the process shown in FIG. 5.

Hereinafter, the operation of the controller 100 and effects of the present embodiment will be described, referring to a time chart shown in FIG. 6.

Figure 6:
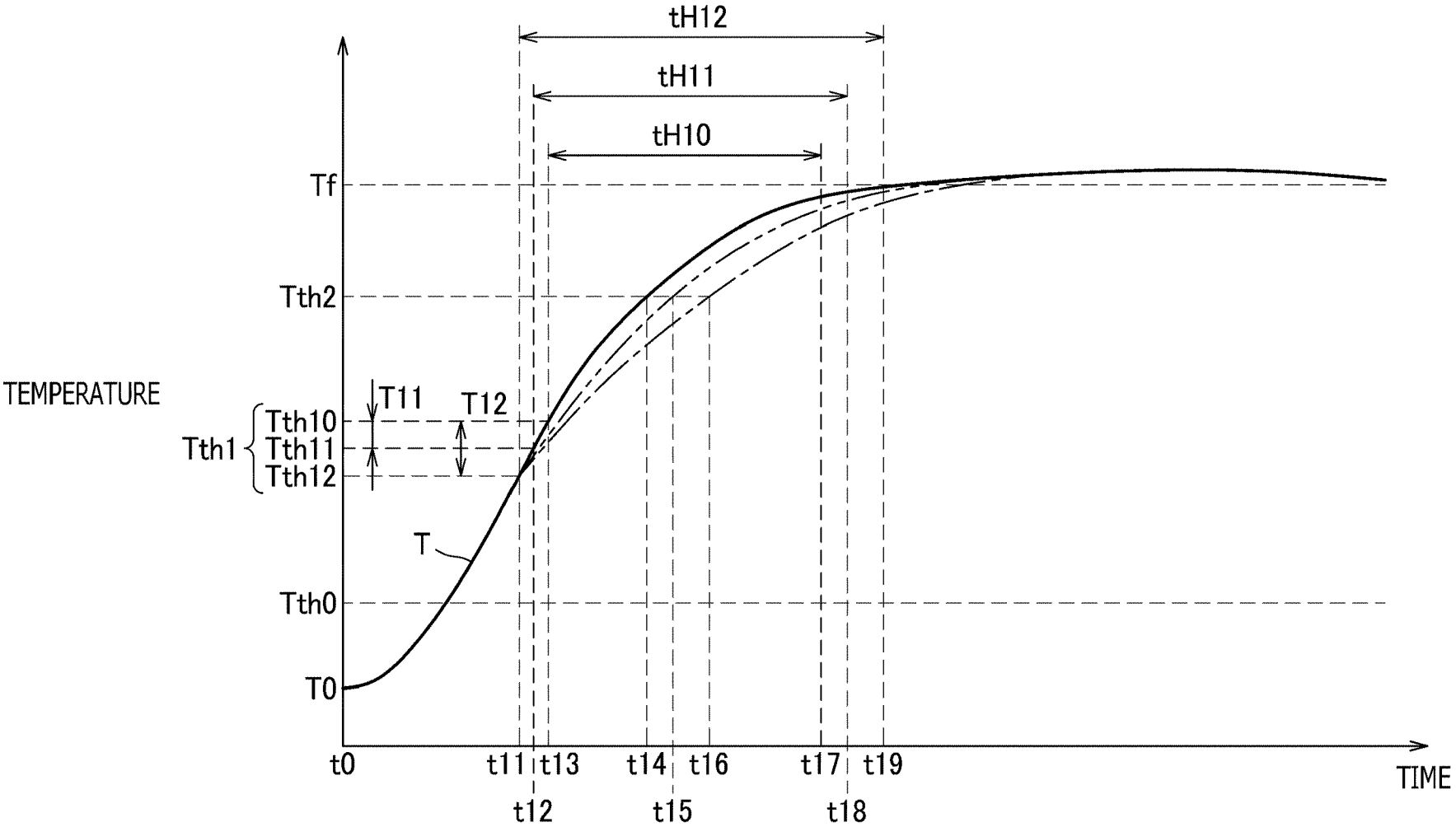
FIG. 6 is a time chart illustrating the operation of the controller according to the first embodiment.

As shown in FIG. 6, when the print job is input at time t0, the controller 100 switches the nip width to the first width N1 or the second width N2, and then starts the heat controlling process. Then, the temperature of the heating roller 81 (the detected temperature T) increases.

When the nip width is the first width N1, the controller 100 sets the first threshold temperature Tth1 to a particular threshold temperature Tth10. Then, at time t13, when the detected temperature T reaches the first threshold temperature Tth1 (Tth10), the controller 100 starts the rotational controlling process of the fixing device 8. It is noted that, as the rotational control of the fixing device 8 is performed, the heat of the heating roller 81 becomes easily conducted to the pressing roller 82 and a temperature rising gradient becomes slightly gentle after time t13.

Thereafter, when the detected temperature T has reached the second threshold temperature Tth2 at time t14, the controller 100 starts conveying the sheet S. Then, the sheet S enters the fixing device 8 at time t17 and fixing is performed. As described above, when the nip width is the first width N1, the heating roller 81 and the pressing roller 82 are rotated and heated from time t13 to time t17 (i.e., for a time period of tH10).

When the nip width is the second width N2, the controller 100 sets the first threshold temperature Tth1 to a temperature Tth11 which is calculated by subtracting the first compensation value T11 from the particular temperature Tth10. Then, at time t12 which is earlier than time t13, the detected temperature T reaches the first threshold temperature Tth1 (Tth11) and the controller 100 starts the rotational controlling process of the fixing device 8.

When the rotational controlling process of the fixing device 8 is started at time t12 which is earlier than time t13, since the heat of the heating roller 81 is conducted to the pressing roller 82, the temperature rising gradient of the heating roller 81 becomes smaller. Accordingly, a time period before the detected temperature T reaches the second threshold temperature Tth2 (i.e., the temperature indicated by two-dotted-line) is longer than a case where the nip width is the first width N1.

When the detected temperature T has reached the second threshold temperature Tth2 at time t14 which is earlier than time t15, the controller 100 starts conveying the sheet S. Then, the sheet S enters the fixing device 8 at time t17 which is later than time t18 and fixing is performed. As described above, when the nip width is the second width N2, the heating roller 81 and the pressing roller 82 are rotated and heated for a time period tH11 (from the time t12 to time t18) which is longer than the time period tH10.

As above, according to the present embodiment, by lowering the first threshold temperature Tth1 in a case where the nip width is the second width N2 than in a case where the nip width is the first width N1 in the rotational controlling process, the rotational controlling process of the fixing device 8 is started at an earlier timing in a case where the nip width is the second width N2 which is smaller than the first nip width N2 than in a case where the nip width is the first width N1. Accordingly, a time period during which the heating roller 81 and the pressing roller 82 are rotating and being heated is elongated, thereby the time period during which the heat of the heating roller 81 is conducted to the pressing roller 82 being elongated. Therefore, the temperature of the pressing roller 82 can be raised within a temperature range appropriate for fixing. Thus, even when the nip width is switched to a smaller width, fixing failure can be suppressed.

Further, the elastic layer 82B of the pressing roller 82 expands as heated, while shrinks as cooled. As the pressing roller 82 has been used for a relatively long period, wrinkles may be formed on the surface thereof as the expansion and shrink are repeated and a contacting area between the pressing roller 82 and the heating roller 81 may be reduced. Therefore, when the usage period of the pressing roller 82 is relatively long, the heat of the hating part 81 may become difficult to be conducted to the pressing roller 82.

According to the present disclosure, when the nip width is the second width N2 and the usage period of the pressing roller 82 is relatively long, the controller 100 changes the first threshold temperature Tth1 to temperature Tth12 which is calculated by subtracting the second compensation value T12, which is larger than the first compensation value T11, from the particular threshold temperature Tth10. Then, the detected temperature T reaches the first threshold temperature Tth1 (Tth12) at time t11 which is earlier than time t12, and the controller 100 starts the rotational controlling process of the fixing device 8 at this timing.

When the rotational controlling process of the fixing device 8 is started at time t111 which is earlier than time t12, as the heat of the heating roller 81 is conducted to the pressing roller 82 and the temperature rising gradient of the heating roller 81 becomes smaller. Accordingly, a time period during which the detected temperature T reaches the second threshold temperature Tth2 (indicated by one-dotted-line) becomes longer in this case than in a case where the nip width is the second width N2 and the usage period of the pressing roller 82 is relatively short.

When the detected temperature T has reached the second threshold temperature Tth2 at time t16 which is later than time t15, the controller 100 starts conveying the sheet S. The sheet S enters the fixing device 8 at time t19 which is later than time t18 and fixing is performed. As above, when the nip width is the second width N2 and the usage period of the pressing roller 82 is relatively long, the heating roller 81 and the pressing roller 82 are rotated and heated for a period tH12 (from t11 to t19) which is longer than the period tH11.

As described above, when the usage period of the fixing device 8 is relatively long, the rotational controlling process of the fixing device 8 is started at an earlier timing thereby the time period during which the heating roller 81 and the pressing roller 82 are rotated and heated being elongated. Accordingly, the time period during which the heat of the heating roller 81 is conducted to the pressing roller 82 is elongated. Thus, the temperature of the pressing roller 82 is raised to be within the temperature range appropriate for fixing. Therefore, even if the usage period of the pressing roller 82 is relatively long, fixing failure can be suppressed.

Next, a laser printer according to a second embodiment will be described. In the following description, components same as those in the first embodiment are assigned with the same reference numerals and detailed description thereof will be omitted, and differences with respect to the first embodiment will be mainly described.

In the second embodiment, the controller 100 is configured to change the second threshold temperature Tth2 instead of the first threshold temperature Tth1. That is, the controller 100 sets the second threshold temperature Tth2 to be higher in a case where the nip width is the second width N2 than in a case where the nip width is the first width N1 in the conveyance controlling process.

For example, when the nip width is the first width N1, the controller 100 sets the second threshold temperature Tth2 to a particular value which is set in advance. On the other hand, when the nip width is the second width N2, the controller 100 sects the second threshold temperature Tth2 to a temperature which is higher than the particular temperature by adding a third compensation value T21 to the particular threshold temperature.

The controller 100 sets the second threshold temperature Tth2 to a higher temperature in a case the nip width is the second width N2 and the usage parameter LP is equal to or larger than the threshold value LPth than in a case where the usage parameter LP is less than the threshold value LPth.

Concretely, when the nip width is the second width N2 and the usage parameter LP is equal to the threshold value LPth or larger, the controller 100 sets the second threshold temperature Tth2 to a temperature obtained by adding a fourth compensation value T22 to the particular threshold temperature. The fourth compensation temperature T22 is larger than the third compensation value T21. Accordingly, the second threshold temperature Tth2 which is obtained by adding the fourth compensation value T22 to the particular threshold value is larger than the second threshold temperature Tth2 which is calculated by adding the third compensation value T21 to the particular threshold temperature.

Next, the operation of the controller 100 according to the second embodiment will be described with reference to a flowchart shown in FIG. 7.

Figure 7:
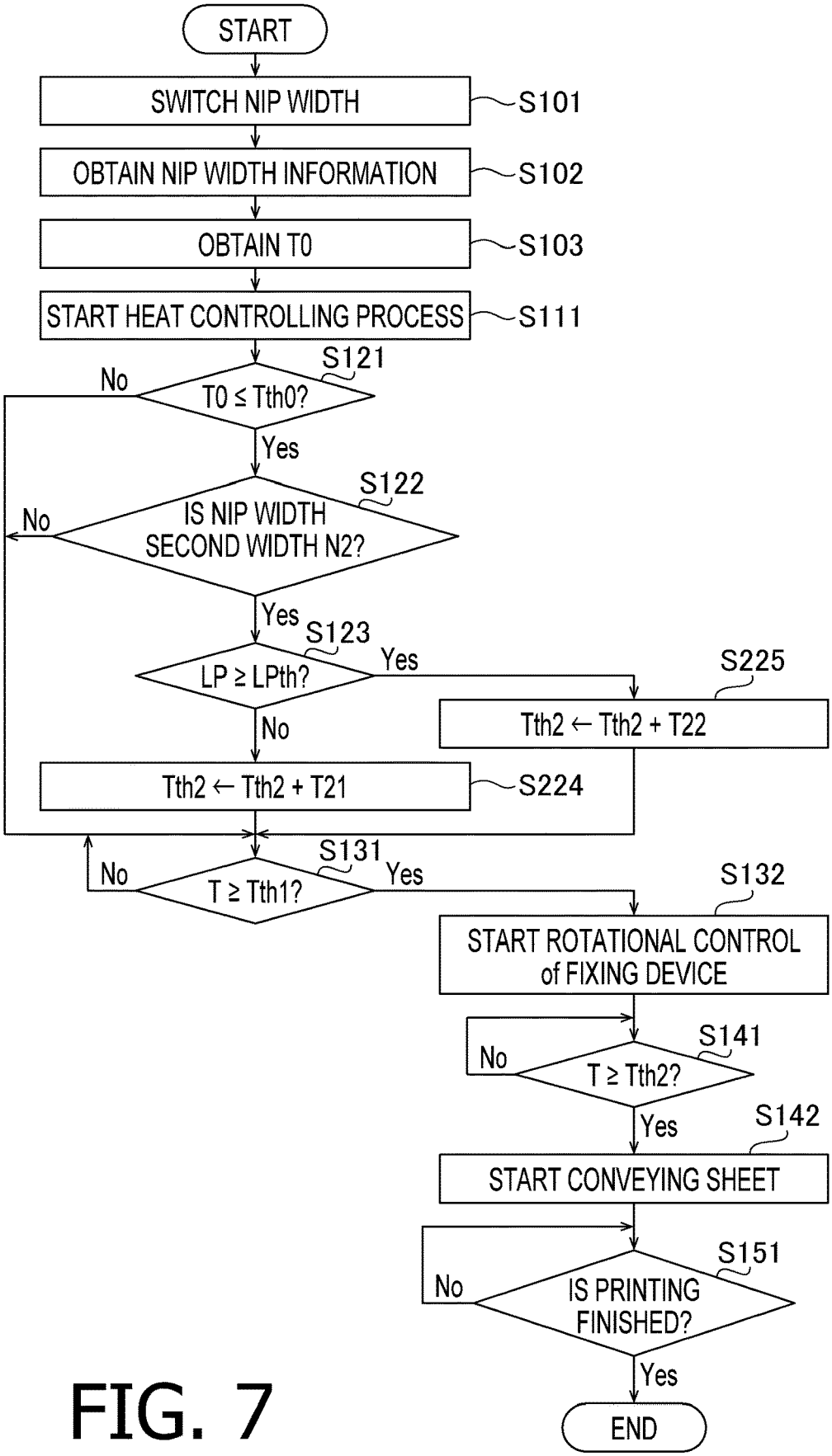
FIG. 7 is a flowchart illustrating an operation of the controller according to a second embodiment.

As shown in FIG. 7, when the usage parameter LP is not equal to or larger than the threshold value LPth (S123: NO), the controller 100 sets the second threshold temperature Tth2 as a temperature which is obtained by adding the third compensation value T21 to the particular threshold temperature (S224) and executes the following processes. When the usage parameter is equal to or larger than the threshold value LPth (S123: YES), the controller 100 sets the second threshold temperature Tth2 to a temperature which is calculated by adding the fourth compensation value 122 to the particular threshold temperature (S225) and performs the following processes.

When it is determined that the detected temperature T is equal to or larger than the second threshold temperature Tth2 according to the nip width or the usage period of the pressing roller 82 (S141: YES), the controller 100 starts conveying the sheet S (S142).

Figure 8:
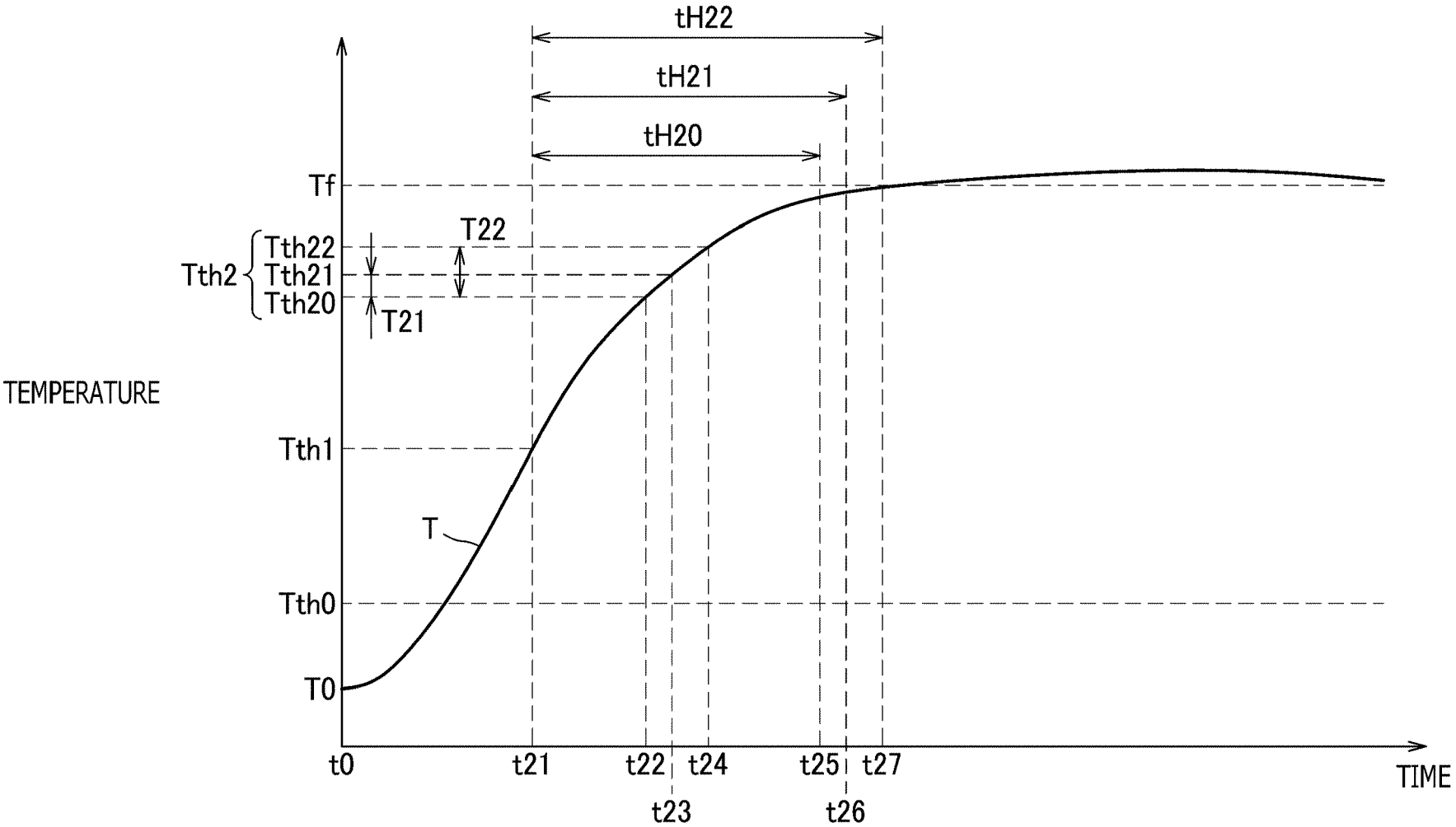
FIG. 8 is a time chart illustrating the operation of the controller according to the second embodiment.

Hereinafter, referring to a time chart shown in FIG. 8, operations and effects of the controller 100 according to the second embodiment will be described.

When the nip width is the first width N1, the controller 100 sets the second threshold temperature Tth2 to the particular threshold temperature Tth20. Then, at time t21, after the detected temperature T20 has reached the first threshold temperature Tth1, the controller starts the rotational controlling process of the fixing device 8. Thereafter, at time t22, when the detected temperature T reaches the second threshold temperature Tth2 (Tth20), the controller 100 starts conveying the sheet S. At time t25, the sheet S enters the fixing device 8 and the controller 100 starts fixing. As above, when the nip width is the first width N1, the heating roller 81 and the pressing roller 82 are rotated and heated for a time period tH20 (i.e., from time t21 to time t25).

When the nip width is the second width N2, the controller 100 sets the second threshold temperature Tth2 to a new second threshold temperature T21 which is the particular threshold temperature Tth20 added with the third compensation value T21. Then, the controller 100 starts the rotational controlling process of the fixing device 8 at time T21, and starts conveying the sheet S at T23, which is later than time T22, when the detected temperature T has reached the second threshold temperature Tth2 (Tth21). Thereafter, at time t26 which is later than time t25, the sheet S enters the fixing device 8 and fixing is performed. As above, when the nip width is the second width N2, the heating roller 81 and the pressing roller 82 are rotated and heated from time t21 to time t26 (during a time period of tH21 which is longer than the time period tH20.

As above, according to the second embodiment, the second threshold temperature Tth2 is set to be larger in a case where the nip width is the second width N2 than in a case where the nip width is the first width N1 in the conveyance controlling process. As a result, conveyance of the sheet S is started at a later timing in a case where the nip width is the second width N2 which is relatively small than in a case where the nip width is the first width N1 which is relatively large. According to the above control, a time period during which the heating roller 81 and the pressing roller 82 are rotated and heated can be elongated so that a time period during which the heat of the heating roller 81 is conducted to the pressing roller 82 is elongated. Therefore, the temperature of the pressing roller 82 can be raised within the temperature range appropriate for fixing, thereby the fixing failure being suppressed.

Further, according to the second embodiment, when the nip width is the second width N2 and the usage period of the pressing roller 82 is relatively long, the controller 100 set the second threshold temperature Tth2 to the threshold temperature Tth22 which is the particular threshold temperature Tth20 added with the fourth compensation value T22 which is larger than the third compensation value T21. Then, after the controller starts the rotational controlling process of the fixing device 8 at time t21, when the detected temperature T has reached the second threshold temperature Tth2 (Tth22) at time t24 which is after the time t23, the controller 100 starts conveying the sheet S. Thereafter, at the time t27 which is after the time 26, the sheet S enters the fixing device 8 and fixing is performed. As above, when the nip width is the second width N2 and the usage period of the pressing roller 82 is relatively long, the heating roller 81 and the pressing roller 82 is rotated and heated during a period tH22 (from the time t21 to the time t27) which is longer the period tH21.

As described above, when the usage period of the pressing roller 82 (the fixing device 8) is relatively long, by starting conveyance of the sheet S at a later timing, the temperature of the pressing roller 82 can be raised within the temperature range appropriate for fixing and the fixing failure can be suppressed.

Hereinafter, an image forming apparatus according to a third embodiment will be described. In the third embodiment, after the heat controlling process is started, and, in the conveyance controlling process, when a particular time period tp has elapsed since the detected temperature T becomes equal to or larger than the second threshold temperature Tth2, the controller 100 starts conveying the sheet S toward the developing device 5. Concretely, the controller 100 starts heating the heat controlling process, and when the particular time period tp has elapsed since the detected temperature T becomes equal to or larger than the second threshold temperature Tth2, the controller 100 conveys out the sheet S toward the developing device 5.

Then, in accordance with the nip width, the controller 100 changes the particular time period tp instead of changing the first threshold temperature Tth1 or the second threshold temperature Tth2. Specifically, in the conveyance controlling process, the controller 100 sets the particular time period tp longer in a case where the nip width is the second width N2 than in a case where the nip width is the first width N1.

For example, when the nip width is the first width N1, the controller 100 sets the particular time period tp to a preliminarily defined value. According to the third embodiment, the preliminarily defined value of the particular period tp is zero (0), but it is only an exemplary value and is not necessarily be zero. On the other hand, when the nip width is the second width N2, the controller 100 sets the particular time period tp to a period which is the preliminarily defined value added with a fifth compensation value tc1. Thus, the particular time period tp is set to a period longer than the preliminarily defined value.

Further, when the nip width is the second width N2 and the usage parameter LP is equal to or larger than the threshold value LPth, the controller 100 sets, in the conveyance controlling process, the particular time period tp to be longer in comparison with a case where the usage parameter LP is less than the threshold value LPth.

Specifically, when the nip width is the second width N2 and the usage parameter LP is equal to or larger than the threshold value LPth, the controller 100 sets the particular time period tp to a period which is the preliminarily defined value added with a sixth compensation value tc2. It is noted that the sixth compensation value tc2 is larger than the fifth compensation value tel. Therefore, the particular time period tp which is the preliminarily defined value added with the sixth compensation value tc2 is longer than the particular time period tp which is the preliminarily defined value added with the fifth compensation value tc1.

Figure 9:
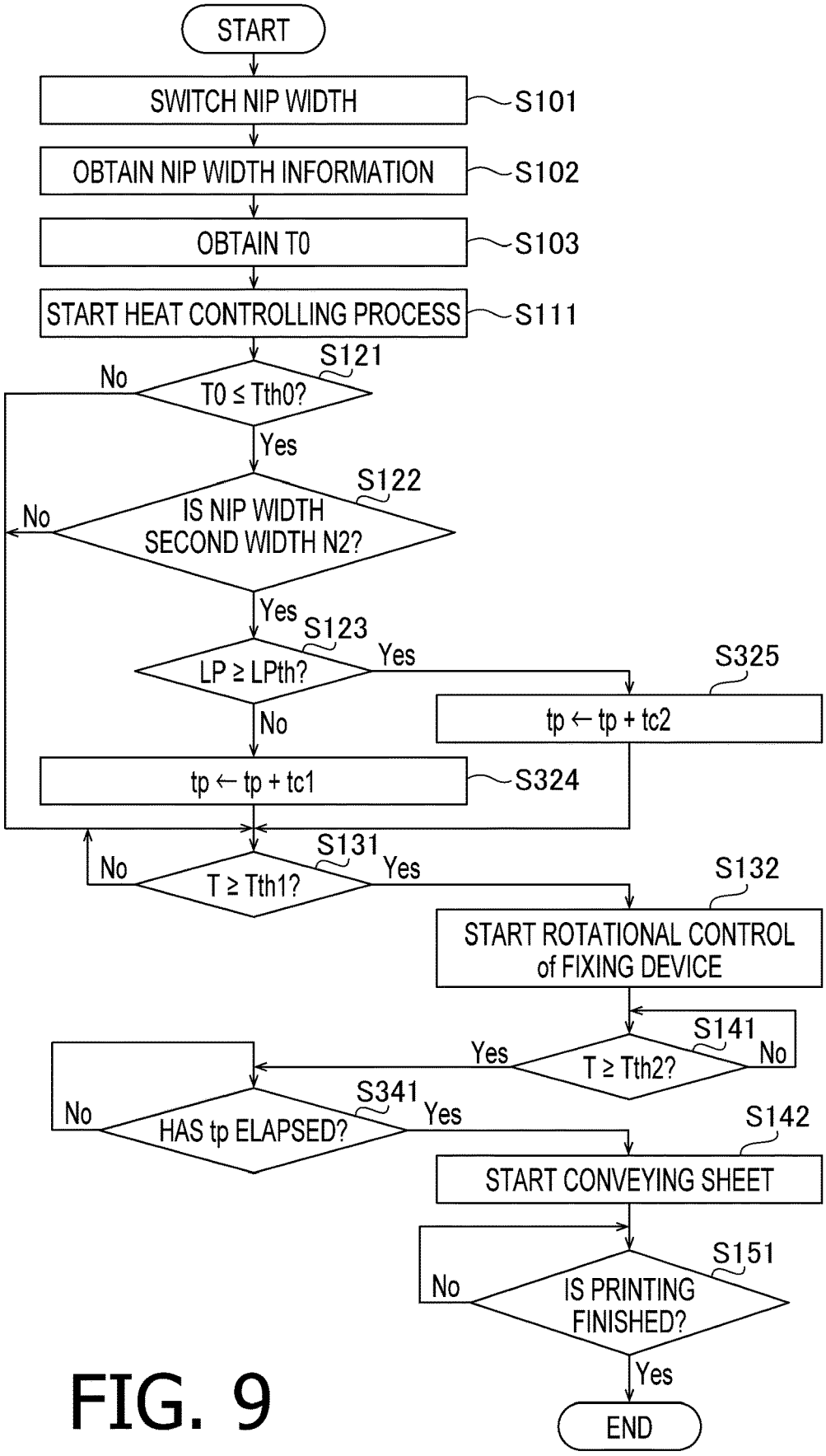
FIG. 9 is a flowchart illustrating an operation of the controller according to a third embodiment.

Hereinafter, the operation of the controller according to the third embodiment will be described with reference to a flowchart shown in FIG. 9. In FIG. 9, when it is determined that the usage parameter LP is not equal to or larger than the threshold value LPth (S123: NO), the controller 100 sets the particular time period tp to a period which is the preliminarily defined value added with the fifth compensation value tc1 (S324) and performs the following processes. When it is determined that the usage parameter LP is equal to or larger than the threshold value LPth (S123: YES), the controller 100 sets the particular time period tp to a period which is the preliminarily defined value added with the sixth compensation value tc2 (S325) and performs the following processes.

When it is determined that the detected temperature T is equal to or larger than the second threshold temperature Tth2 (S141: YES), the controller 100 determines whether or not the particular time period tp corresponding to the nip width or the usage period of the pressing roller 82 has elapsed since the detected temperature T becomes equal to or larger than the second threshold temperature Tth2 (S341). When it is determined that the particular time period tp has elapsed (S341: YES), the controller 100 starts conveying the sheet S (S142).

Figure 10:
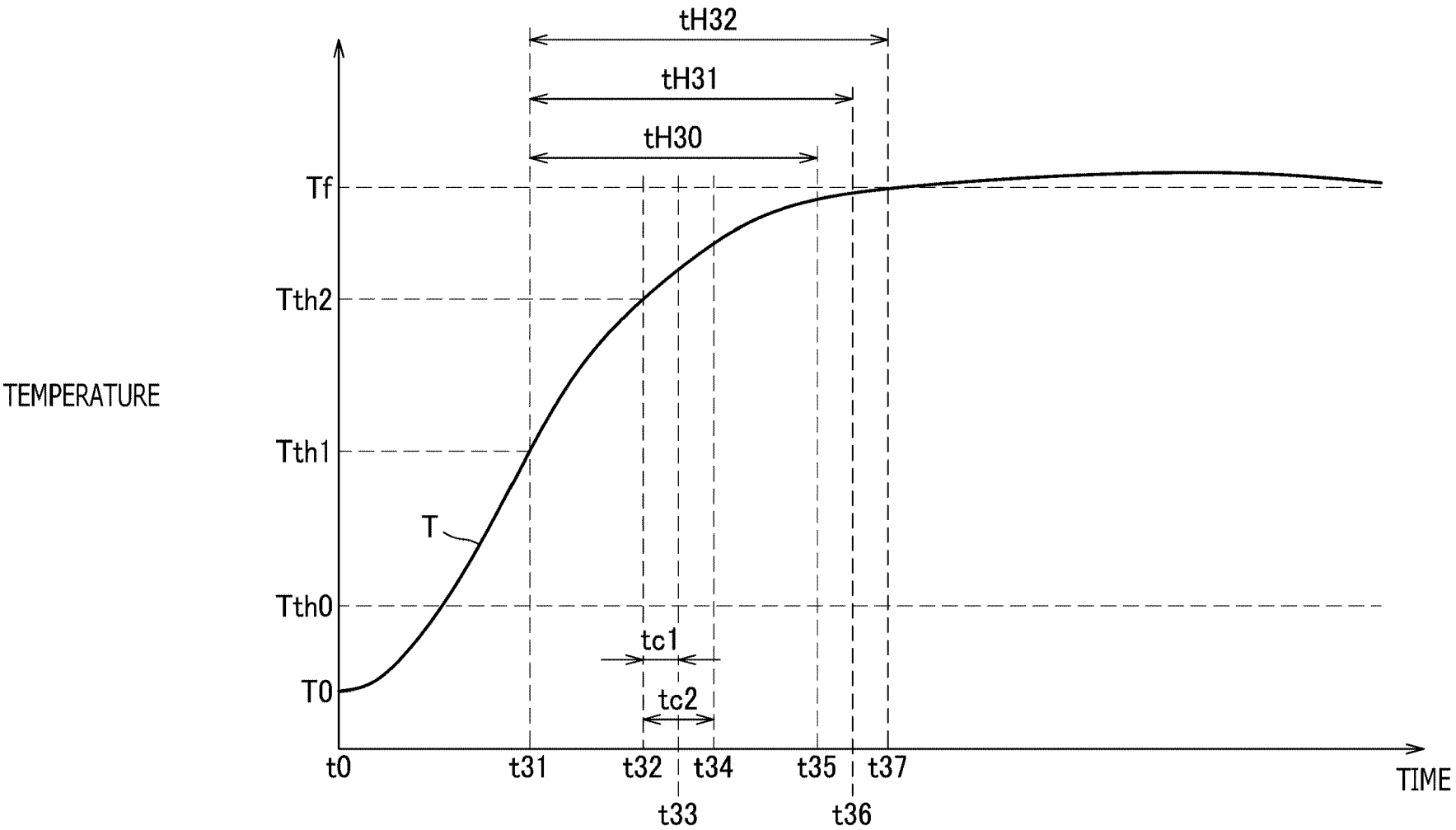
FIG. 10 is a time chart illustrating the operation of the controller according to the third embodiment.

Next, operations and effects of the controller 100 according to the present embodiment will be described with reference to a time chart shown in FIG. 10.

When the nip width is the first width N1, the controller 100 sets the particular time period to a preliminarily defined value (0). Then, after the detected temperature T has reached the first threshold temperature Tth1 and the controller 100 starts the rotational controlling process of the fixing device 8 at time t31, when the detected temperature T has reached the second threshold temperature Tth2, the controller 100 starts conveying the sheet S at time t32. Thereafter, at time t35, the sheet S enters the fixing device 8 and fixing is performed. Thus, when the nip width is the first width N1, the heating roller 81 and the pressing roller 82 are rotated and heated for a time period tH30 (from time t31 to time t35).

On the other hand, when the nip width is the second width N2, the controller 100 sets the particular time period tp to a time which is the preliminarily defined value added with a fifth compensation value tc1. Then, the controller 100 starts the rotational controlling process of the fixing device 8 at time t31. Thereafter, at time t32, the detected temperature T reaches the second threshold temperature Tth2 at time t32, and the controller 100 starts conveying the sheet S at time t33 after elapse of the particular time period tp (tc1). Thereafter, at time t36 which is after time t35, the sheet S enters the fixing device 8 and fixing is performed. As above, when the nip width is the second width N2, the heating roller 81 and the pressing roller 82 are rotated and heated for a time period tH31, which is longer than the time period tH30, from time t31 to time t36.

As above, according to the present embodiment, the particular time period tp is set to be a longer time period in a case where the nip width is the second width N2 than in a caser where the nip width is the first width N1. Accordingly, conveyance of the sheet S is started at a later timing in a case where the nip width is the first width N1 than a case where the nip width is the first width N1 which is larger than the second nip width N2. Accordingly, a time period during which the heat of the heating roller 81 is conducted to the pressing roller 82 and the temperature of the pressing roller 82 is raised within a temperature range appropriate for fixing, thereby fixing failure being suppressed.

Further, according to the present embodiment, when the nip width is the second width N2 and the usage period of the pressing roller 82 is relatively long, the controller 100 sets the particular time period tp to a time period which is the preliminarily defined time period added with a sixth compensation value tc2 which is larger than the fifth compensation value tel. Then, after the controller 100 starts the rotational controlling process of the fixing device 8 at time t31, the detected temperature T reaches the second threshold temperature Tth2 at time t32, and at time t34, at which the particular time period tp (tc2) has elapsed, conveyance of the sheet S is started. At time t37, which is after time t36, the sheet S enters the fixing device 8 and fixing is performed. As above, when the nip width is the second width N2 and the usage period of the pressing roller 82 is relatively long, the heating roller 81 and the pressing roller 82 are rotated and heated for a time period tH32, which is longer than the time period tH31, from time t31 to time t37.

As above, when the usage period of the pressing roller 82 (fixing device 8) is relatively long, conveyance of the sheet S is started at a later timing. Then, the temperature of the pressing roller 82 is raised within the temperature range appropriate for fixing, thereby fixing failure being suppressed.

The embodiments according to the present disclosures are described above. It is noted that aspects of the present disclosures need not be limited to the configurations of the above-described embodiments but can be modified in various ways without departing from aspects of the present disclosures.

For example, according to the embodiments, the spring 86 is configured to press the pressing roller 82 when the nip width is the first width N1, while the spring 86 does not when the nip width is the second width N2. The configuration may be modified such that the spring 86 is configured to press the pressing roller 82 with a first pressing force when the nip width is the first width N1 and with a second pressing force when the nip width is the second width N2 which is weaker than the first pressing force. Alternatively, the spring may be configured to press the heating roller 81 toward the pressing roller. It is noted that the sprint may be ones (e.g., a compression coil spring, a torsion spring and the like) other than the tension coil spring.

Figure 11:
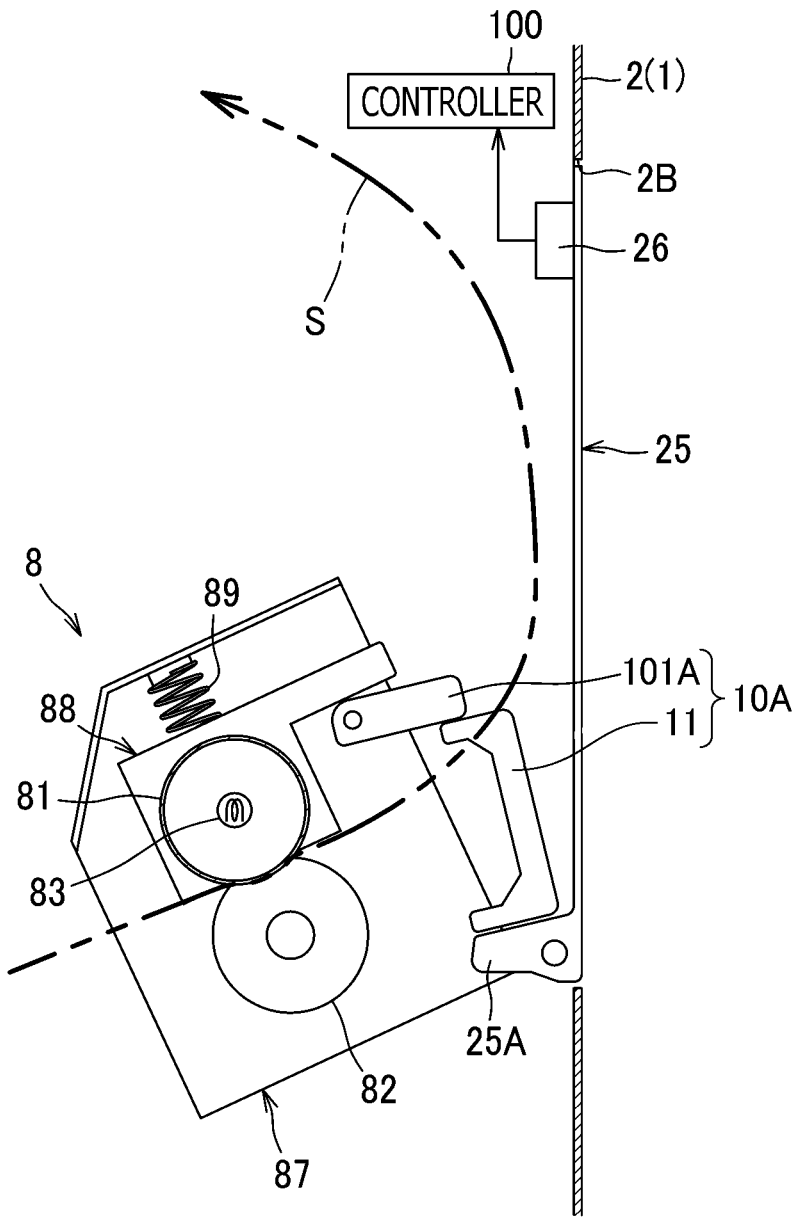
FIG. 11 shows a fixing device provided with a switching mechanism and having a first width according to a modification.

In the above-described embodiments, the nip width information is obtained based on the detection result of the position detector 16 which is configured to detect a position of the cam 101, but the configuration may be modified. For example, a configuration as shown in FIG. 11 may be employed. In the configuration shown in FIG. 11, the laser printer 1 is provided with a rear cover 25 which is an example of a conveying passage changing member and a position detector 26 configured to detect a position of the rear cover 25. Further, a switching mechanism 10A is provided to switch the nip width in association with a movement of the rear cover 25, and the controller 100 may obtain the nip width information based on a detection result of the position detector 26.

Figure 12:
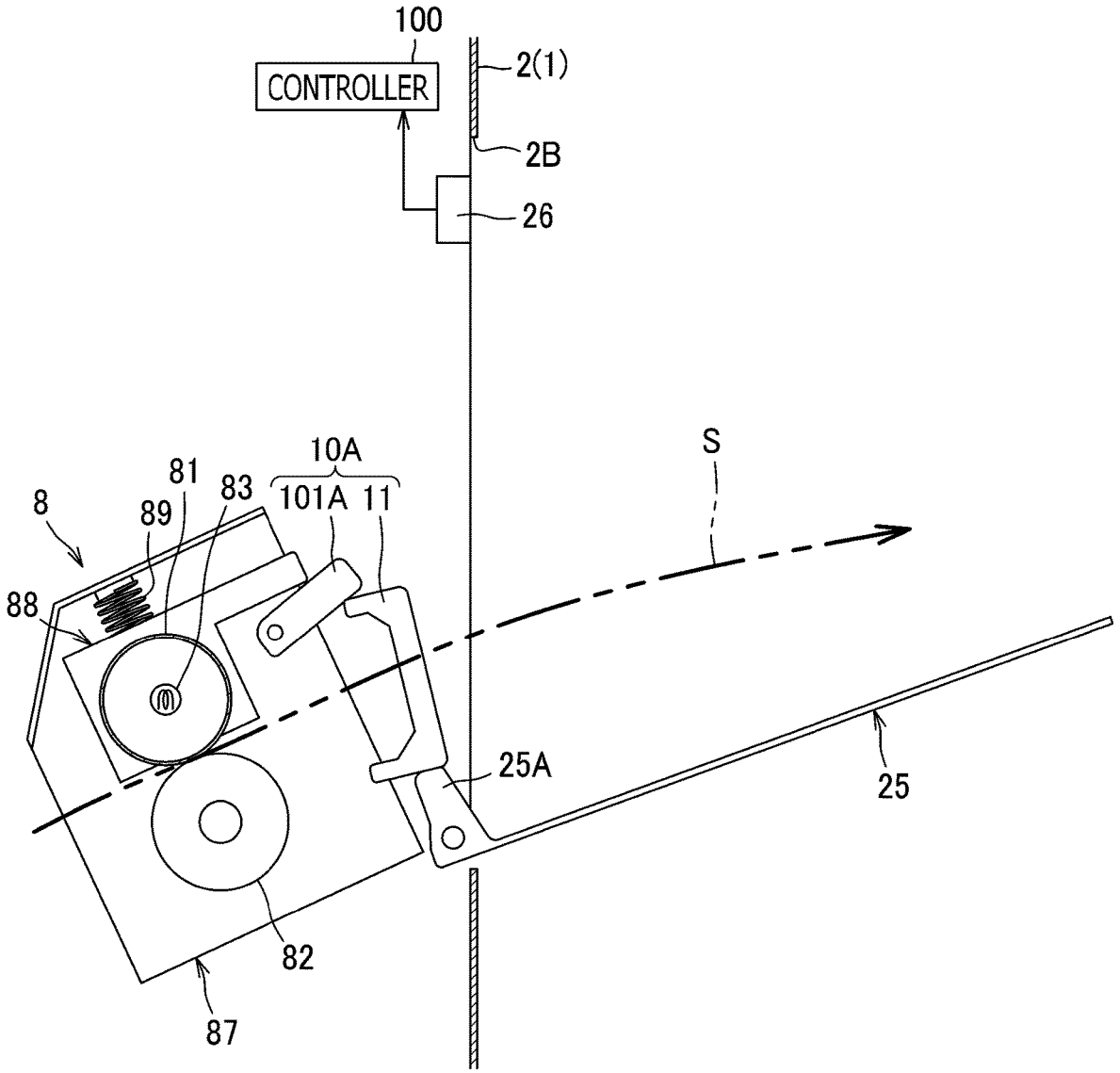
FIG. 12 shows a fixing device provided with the switching mechanism and having a second width according to a modification.

In the above modification, the rear cover 26 is provided on the rear portion of the casing 2 and movable, relative to the casing 2, between a first position, at which the rear cover 25 closes an opening 2B formed on a rear wall of the casing 2, and a second position, at which the rear cover 25 exposes the opening 2B as shown in FIG. 12.

When the rear cover 25 is located at the first position (see FIG. 11), the rear cover 25 guides the sheet S which is ejected from the fixing device 8 toward a portion above the fixing device in a curved state, thereby the sheet S is guided onto a discharged sheet tray 22 (cf. FIG. 1) outside the casing 2. When the rear cover 25 is located at the second position (see FIG. 12), the rear cover 25 guides the sheet S ejected from the fixing device 8 outside the casing through the opening 2B without bending. It is noted that, when located at the second position, the rear cover 25 serves as a second discharge tray on which the discharged sheets S are stacked. In other words, at least parts of the passages of the sheet S are defined by the rear cover 25 and are switched depending on the location of the rear cover 25, and the nip width is changed in accordance with the passage corresponding to the location of the rear cover 25.

The position detector 26 is a sensor configured to detect an opened/closed state of the rear cover 25. According to one example, when the rear cover 25 is located at the first position, the position detector 26 outputs an ON signal to the controller 100, while the position detector 26 outputs an OFF signal (or, does not output the ON signal) to the controller 100 when the rear cover 25 is located at the second position.

The fixing device 8 has a first frame 87 supporting the pressing roller 82, a second frame 88 supporting the heating roller 81 and a spring 89. The second frame 88 is slidably supported by a housing of the fixing device 8 such that the second frame 88 is movable, with respect to the first frame 87, in a substantially up-down direction. Further, the spring 89 is configured to push the heating roller 81 toward the pressing roller 82 via the second frame 88.

The switching mechanism 10A is configured such that, when the rear cover 25 moves from the second position to the first position, the switching mechanism 10A is configured to switch the nip width to the first width N1, and when the rear cover 25 moves from the first position to the second position the switching mechanism 10A switches the nip width to the second width N2. The switching mechanism 10A has a rod 11 and a cam 101A. The rod 11 is slidably supported by the casing 2 so as to be movable, with respect to the casing 2, in the substantially up-down direction. Further, the cam 101A is rotatably supported by the first frame 87.

When the rear cover 25 is moved from the first position (see FIG. 11) to the second position (see FIG. 12), a lifting part 25A provided to the rear cover 25 pushes up the rod 11, thereby the cam 101A rotating counterclockwise in FIGS. 11 and 12. As the cam 101A rotates counterclockwise, the second frame 88 is pushed upward, together with the heating roller 81, against the pressing force of the spring 89, and the nip width is set to the second width N2 which is smaller than the first nip width N1.

When the rear cover 25 is moved from the second position (see FIG. 12) to the first position (see FIG. 11), the rod 11 is moved downward and the cam 101A rotates clockwise in FIG. 11. The spring 89 pushes down the second frame 88 and the heating roller 81 is strongly urged against the pressing roller 82, thereby the nip width being set to the first width N1 which is wider than the second width N2.

It is noted that, according to the present embodiment, the heating roller 81 is configured to be urged toward the pressing roller 82. The configuration may be modified such that the pressing roller 82 is urged toward the heating roller 81.

When the rear cover 25 is moved to be located at the first position (see FIG. 11) and the ON signal is output by the position detector 26, the controller 100 determines that the nip width is the first width N1. When the rear cover 25 is moved to be located at the second position (see FIG. 12) and the OFF signal is output by the position detector 26, the controller 100 determines that the nip width is the second width N2.

It is noted that the switching mechanism may be configured to switch the nip width based on a type of the sheet S selected by the user. In such a configuration, the controller may obtain the nip width information based on selected sheet type information. For example, when the normal sheet is selected, the controller may determine that the nip width is the first width N1, and when the thick paper or envelope is selected, the controller may determine that the nip width is the second width N2.

According to the first embodiment, in a case where the nip width is the second width N2, when the usage period of the pressing roller 82 is relatively long, the first threshold temperature Tth1 is lowered. However, aspects of the present disclosures need not be limited to such a configuration. For example, even if the nip width is the first width N1, when the usage period of the pressing roller is relatively long, the first threshold temperature may be lowered. For another example, in a case where the nip width is the first width N1, when the usage period of the pressing roller is relatively long, the second threshold temperature may be raised and/or the particular time period may be elongated.

In the above-described embodiments, the switching mechanism is configured to switch the nip width in two steps (i.e., between the first width N1 and the second width N2). The configuration may be modified such that the switching mechanism switches the nip width in three or more steps.

According to the above-described embodiments, in the rotational controlling process, the fixing device 8 is rotated by driving the second motor M2. This configuration may be modified such that, in the rotational controlling process, the fixing device 8 is rotated by transmitting a driving force of the motor to the fixing device 8 with use of a clutch mechanism.

In the above-described embodiments, the temperature detector 9 is configured to detect the temperature of the heating roller 81. The configuration may be modified such that the temperature detector may detect the temperature of the pressing roller or the heating roller. Further, the temperature sensor 9 may be any sensor other than the thermistor. Furthermore, the temperature sensor may be a non-contact type temperature sensor or a contact type temperature sensor.

In the above-described embodiments, the controller 100 is configured to switch the nip width by controlling the first motor M1 to drive, and obtain nip width information based on the detection result of the position detector 16. The configuration may be modified such that the nip width information is obtained based on control history of the controller, but not based on the detection result of the position detector 16. Alternatively, the nip width information may be obtained based on a combination of the detection result of the position detector 16 and the control history of the first motor M1.

In the above-described embodiments, the heating roller 81 is configured to include a roller. The configuration may be modified such that the heating roller 81 includes, for example, a heating unit provided with an endless belt as a heating belt configured to rotate. Further, in the above-described embodiments, the pressing roller 82 includes the pressing roller. The configuration may be modified such that the pressing roller 82 may be a pressing unit including an endless pressing belt configured to rotate.

In the above-described embodiments, the heater 83 includes the halogen heater which makes use of radiation heat. The configuration may be modified such that the heater my include a heating resistor provided on a substrate, a ceramic heater, a carbon heater or the like. Further, the heater may not be arrange inside the heating roller, but outside the heating roller.

In the above-described embodiments, as an example of the image forming apparatus, a laser printer 1 configured to form a monochromatic image on the sheet S is described. The configuration may be modified such that the image forming apparatus may be a printer configured form a color image on the sheet. Further, the image forming apparatus need not be limited to the printer but can be, for example, a copier or an MFP provided with an original reading device such as a flatbed scanner as well as a printing device.

In the above-described embodiments, as an example of the developing device 5, a process cartridge is described. Aspects of the present disclosures need not be limited to such a configuration. For example, when the image forming apparatus is configured to form a color image on a sheet, and has a process unit provided with a plurality of arranged photosensitive bodies and a transfer unit provided with a transfer belt which is used to transfer developer images formed on the plurality of photosensitive bodies onto the sheet, and the like. In such a case, the developer image forming unit may be configured to include both the process unit and the transfer unit.

It is further noted that components in the above-described embodiments and the modifications can be appropriately.

What is claimed is:

1. An image forming apparatus, comprising:

a developing device configured to form a developer image on a sheet;

a conveyer configured to convey the sheet toward the developing device;

a heating roller configured to heat the sheet; and a pressing roller configured to press the sheet in association with the heating roller;

a temperature detector configured to detect a temperature of the heating roller;

a switching mechanism configured to switch a nip width of a nip portion, which is formed between the heating roller and the pressing roller, between a first width and a second width, the second width being smaller than the first width; and a controller, wherein the controller is configured to perform:

a heating controlling process of raising the temperature of the heating roller toward a fixing temperature necessary to fix the developer image on the sheet based on a detected temperature which is the temperature detected by the temperature detector;

a rotational controlling process, the controller not rotating the heating roller or the pressing roller when the detected temperature is lower than a first temperature which is lower than the fixing temperature, the controller rotating the heating roller and the pressing roller when the detected temperature is equal to or higher than the first temperature; and a conveyance controlling process of controlling the conveyer to convey the sheet toward the developing device when the detected temperature is equal to or higher than a second temperature, which is higher than the first temperature and lower than the fixing temperature, and wherein, in the rotational controlling process, the controller sets the first temperature to be lower in a case where the nip width is the second width than in a case where the nip width is the first width.

2. The image forming apparatus according to claim 1, wherein the pressing roller has an elastic layer, and wherein, in the rotational controlling process, the controller sets the first temperature to a temperature lower in a case where a parameter which increases in association with usage amount of the pressing roller is equal to or larger than a threshold value than in a case where the parameter is less than the threshold value.

3. The image forming apparatus according to claim 1, further comprising a heater configured to heat the heating roller and the pressing roller, wherein, in the heat controlling process, the controller is configured to control the temperature of the heating roller at a duty ratio of voltage for energizing the heat source in accordance with a difference between the fixing temperature and the detected temperature, the duty ratio being set to be larger as the difference being larger.

4. The image forming apparatus according to claim 1, further comprising a spring configured to urge one of the heating roller and the pressing roller toward an other one of the heating roller and the pressing roller, wherein the pressing roller comprises an elastic layer, and wherein the nip portion having the first nip width is formed by an urging force of the spring to urge one of the heating roller and the pressing roller toward the other one of the heating roller and the pressing roller and elasticity of the elastic layer, and wherein the nip portion having the second nip width is formed only by the elasticity of the elastic layer.

5. The image forming apparatus according to claim 1, further comprising a drive source configured to cause the switching mechanism to switch the nip width between the first width and the second width, wherein the controller is configured to perform the heat controlling process after switching the nip width based on setting information of the nip width.

6. The image forming apparatus according to claim 1, further comprising:

a conveying passage changing member configured to be located at a first position and the second position to change a passage of the sheet which is conveyed from a location where the heating roller and the pressing roller are located; and a position detector configured to detect a position of the conveying passage changing member, wherein the switching mechanism is configured to switch, in association with movement of the conveying passage changing member, the nip width to the first width when the conveying passage changing member moves from the second position to the first position and to the second width when the conveying passage changing member moves from the first position to the second position, and wherein the controller obtains the nip width information based on a detection result of the position detector.

7. An image forming apparatus, comprising:

a developing device configured to form a developer image on a sheet;

a conveyer configured to convey the sheet toward the developing device;

a heating roller configured to heat the sheet; and a pressing roller configured to press the sheet in association with the heating roller;

a temperature detector configured to detect a temperature of the heating roller;

a switching mechanism configured to switch a width of a nip, which is formed between the heating roller and the pressing roller, between a first width and a second width, the second width being smaller than the first width; and a controller, wherein the controller is configured to perform:

a heating controlling process of raising the temperature of the heating roller toward a fixing temperature necessary to fix the developer image on the sheet based on a detected temperature which is the temperature detected by the temperature detector;

a rotational controlling process, the controller not rotating the heating roller or the pressing roller when the detected temperature is a less than a first temperature which is lower than the fixing temperature, the controller rotating the heating roller and the pressing roller when the detected temperature is equal to or higher than the first temperature; and a conveyance controlling process of controlling the conveyer to convey the sheet toward the developing device when the detected temperature is equal to or higher than a second temperature which is higher than the first temperature and lower than the fixing temperature, and wherein, in the conveyance controlling process, the controller sets the second temperature to be higher in a case where the nip width is the second width than in a case where the nip width is the first width.

8. The image forming apparatus according to claim 7, wherein the pressing roller has an elastic layer, and wherein, in the conveyance controlling process, the controller sets the second temperature to a temperature higher in a case where a parameter which increases in association with usage amount of the pressing roller is equal to or larger than a threshold value than in a case where the parameter is less than the threshold value.

9. The image forming apparatus according to claim 7, further comprising a heater configured to heat the heating roller and the pressing roller, wherein, in the heat controlling process, the controller is configured to control the temperature of the heating roller at a duty ratio of voltage for energizing the heat source in accordance with a difference between the fixing temperature and the detected temperature, the duty ratio being set to be larger as the difference being larger.

10. The image forming apparatus according to claim 7, further comprising a spring configured to urge one of the heating roller and the pressing roller toward an other one of the heating roller and the pressing roller, wherein the pressing roller comprises an elastic layer, and wherein the nip portion having the first nip width is formed by an urging force of the spring to urge one of the heating roller and the pressing roller toward the other one of the heating roller and the pressing roller and elasticity of the elastic layer, and the nip portion having the second nip width is formed only by the elasticity of the elastic layer.

11. The image forming apparatus according to claim 7, further comprising a drive source configured to cause the switching mechanism to switch the nip width between the first width and the second width, wherein the controller is configured to perform the heat controlling process after switching the nip width based on setting information of the nip width.

12. The image forming apparatus according to claim 7, further comprising:

a conveying passage changing member configured to be located at a first position and the second position, to change a passage of the sheet which is conveyed from a location where the heating roller and the pressing roller are located; and a position detector configured to detect a position of the conveying passage changing member, wherein the switching mechanism is configured to switch, in association with movement of the conveying passage changing member, the nip width to the first width when the conveying passage changing member moves from the second position to the first position and to the second width when the conveying passage changing member moves from the first position to the second position, and wherein the controller obtains the nip width information based on a detection result of the position detector.

13. An image forming apparatus, comprising:

a developing device configured to form a developer image on a sheet;

a conveyer configured to convey the sheet toward the developing device;

a heating roller configured to heat the sheet; and a pressing roller configured to press sheet in association with the heating roller;

a temperature detector configured to detect a temperature of the heating roller;

a switching mechanism configured to switch a width of a nip between the heating roller and the pressing roller between a first width and a second width, the second width being smaller than the first width; and a controller, wherein the controller is configured to perform:

a heating controlling process of raising the temperature of the heating roller toward a fixing temperature necessary to fix the developer image on the sheet based on a detected temperature which is the temperature detected by the temperature detector;

a rotational controlling process, the controller not rotating the heating roller or the pressing roller when the detected temperature is a less than a first temperature which is lower than the fixing temperature, the controller rotating the heating roller and the pressing roller when the detected temperature is equal to or higher than the first temperature; and a conveyance controlling process of controlling the conveyer to convey the sheet toward the developing device after a particular time period has elapsed since the detected temperature becomes a second temperature which is higher than the first temperature and lower than the fixing temperature, and wherein, in the conveyance controlling process, the controller sets the particular time period to be longer in a case where the nip width is the second width than in a case where the nip width is the first width.

14. The image forming apparatus according to claim 13, wherein the pressing roller has an elastic layer, and wherein, in the conveyance controlling process, the controller sets the particular time period to a period longer in a case where a parameter which increases in association with usage amount of the pressing roller is equal to or larger than a threshold value than in a case where the parameter is less than the threshold value.

15. The image forming apparatus according to claim 13, further comprising a heater configured to heat the heating roller and the pressing roller, wherein, in the heat controlling process, the controller is configured to control the temperature of the heating roller at a duty ratio of voltage for energizing the heat source in accordance with a difference between the fixing temperature and the detected temperature, the duty ratio being set to be larger as the difference being larger.

16. The image forming apparatus according to claim 13, further comprising a spring configured to urge one of the heating roller and the pressing roller toward an other one of the heating roller and the pressing roller, wherein the pressing roller comprises an elastic layer, and wherein the nip portion having the first nip width is formed by an urging force of the spring to urge one of the heating roller and the pressing roller toward the other one of the heating roller and the pressing roller and elasticity of the elastic layer, and wherein the nip portion having the second nip width is formed only by the elasticity of the elastic layer.

17. The image forming apparatus according to claim 13, further comprising a drive source configured to cause the switching mechanism to switch the nip width between the first width and the second width, wherein the controller is configured to perform the heat controlling process after switching the nip width based on setting information of the nip width.

18. The image forming apparatus according to claim 13, further comprising:

a conveying passage changing member configured to be located at a first position and the second position to change a passage of the sheet which is conveyed from a location where the heating roller and the pressing roller are located; and a position detector configured to detect a position of the conveying passage changing member, wherein the switching mechanism is configured to switch, in association with movement of the conveying passage changing member, the nip width to the first width when the conveying passage changing member moves from the second position to the first position and to the second width when the conveying passage changing member moves from the first position to the second position, and wherein the controller obtains the nip width information based on a detection result of the position detector.

* * * * *